US007300070B2

(12) United States Patent
Pelchat

(10) Patent No.: US 7,300,070 B2
(45) Date of Patent: Nov. 27, 2007

(54) BINDING MOUNTING SYSTEM FOR RECREATIONAL BOARD

(76) Inventor: Jean-Francois Pelchat, 9217 Pinetree La., Whistler, BC (CA) V0N 1B9

( * ) Notice: Subject to any disclaimer, the term of this patent is extended or adjusted under 35 U.S.C. 154(b) by 302 days.

(21) Appl. No.: 10/841,573

(22) Filed: May 10, 2004

(65) Prior Publication Data

US 2005/0248129 A1 Nov. 10, 2005

(51) Int. Cl.
*A63C 9/10* (2006.01)

(52) U.S. Cl. ..... 280/617; 280/618; 280/14.24

(58) Field of Classification Search ..... 280/617, 280/618, 623, 626, 629, 633, 14.21, 14.22, 280/14.24

See application file for complete search history.

(56) References Cited

U.S. PATENT DOCUMENTS

| | | | |
|---|---|---|---|
| 2,740,972 | A | 4/1956 | Taylor |
| 2,933,741 | A | 4/1960 | Walter |
| 3,102,279 | A | 9/1963 | Bennett |
| 3,127,623 | A | 4/1964 | Roudebush |
| 4,728,116 | A | 3/1988 | Hill |
| 4,871,337 | A | 10/1989 | Harris |
| 5,021,017 | A | 6/1991 | Ott |
| 5,028,068 | A | 7/1991 | Donovan |
| 5,261,689 | A | 11/1993 | Carpenter et al. |
| 5,277,635 | A | 1/1994 | Gillis |
| 5,354,088 | A | 10/1994 | Vetter et al. |
| 5,356,170 | A | 10/1994 | Carpenter et al. |
| 5,433,636 | A | 7/1995 | Gillis |
| 5,499,837 | A | 3/1996 | Hale et al. |
| 5,553,883 | A | 9/1996 | Erb |
| 5,577,755 | A | 11/1996 | Metzger et al. |
| 5,584,492 | A | 12/1996 | Fardie |
| 5,586,779 | A | 12/1996 | Dawes et al. |
| 5,660,410 | A | 8/1997 | Alden |
| 5,667,237 | A | 9/1997 | Lauer |
| 5,826,910 | A | 10/1998 | Ricks et al. |
| 5,909,893 | A | 6/1999 | Keller et al. |

(Continued)

FOREIGN PATENT DOCUMENTS

AT WO 02/053240 A1 7/2002

(Continued)

*Primary Examiner*—Christopher P. Ellis
*Assistant Examiner*—Brian Swenson
(74) *Attorney, Agent, or Firm*—Oyen Wiggs Green & Mutala LLP

(57) ABSTRACT

Aspects of this invention provide binding mounting systems for recreational boards. The board comprises a longitudinally extending chamber corresponding to each binding. The binding mounting system includes a slider assembly comprising a slider member, at least a portion of which is disposed to move longitudinally within the chamber and a slider retaining mechanism for engaging the slider member. The slider assembly is adjustable to a first configuration wherein the slider member is longitudinally moveable relative to the chamber and to a second configuration wherein the slider member is fixed relative to the chamber. The binding mounting system also comprises a binding positioned atop a rider support surface of the board and a binding retaining mechanism for engaging the slider and/or the slider retaining mechanism to couple the binding thereto. The binding assembly is adjustable to a first configuration wherein an angular orientation of the binding is adjustable relative to the board and to a second configuration wherein the angular orientation of the binding is fixed relative to the board.

42 Claims, 21 Drawing Sheets

U.S. PATENT DOCUMENTS

| | | | | |
|---|---|---|---|---|
| 5,915,718 | A | 6/1999 | Dodge | |
| 5,947,488 | A | 9/1999 | Gorza et al. | |
| 5,947,508 | A * | 9/1999 | Graf et al. | 280/616 |
| 5,967,542 | A | 10/1999 | Williams et al. | |
| 5,984,346 | A | 11/1999 | Keller | |
| 6,015,161 | A | 1/2000 | Carlson | |
| 6,062,584 | A | 5/2000 | Sabol | |
| 6,089,581 | A | 7/2000 | Partridge | |
| 6,155,578 | A | 12/2000 | Patterson | |
| 6,189,899 | B1 | 2/2001 | Carlson | |
| 6,189,911 | B1 | 2/2001 | Caron et al. | |
| 6,203,051 | B1 | 3/2001 | Sabol | |
| 6,428,032 | B1 * | 8/2002 | Humbel | 280/613 |
| 6,491,310 | B1 | 12/2002 | Work | |
| 6,523,851 | B1 | 2/2003 | Maravetz | |
| 6,789,806 | B2 * | 9/2004 | Santa Cruz et al. | 280/14.21 |
| 6,945,544 | B2 * | 9/2005 | Feurer et al. | 280/14.22 |
| 7,063,346 | B2 * | 6/2006 | Elkington | 280/618 |
| 2001/0038182 | A1 | 11/2001 | Carlson | |
| 2002/0185840 | A1 | 12/2002 | Schaller et al. | |
| 2002/0185841 | A1 | 12/2002 | Schaller et al. | |
| 2003/0011171 | A1 | 1/2003 | Battistella | |
| 2003/0042709 | A1 | 3/2003 | Dodge | |
| 2003/0116931 | A1 | 6/2003 | Quatrro et al. | |
| 2003/0178812 | A1 | 9/2003 | Schaller et al. | |
| 2003/0189316 | A1 | 10/2003 | Schaller et al. | |
| 2003/0209881 | A1 | 11/2003 | Krumbeck et al. | |
| 2003/0230870 | A1 | 12/2003 | Sabol | |
| 2004/0017064 | A1 | 1/2004 | Brown et al. | |

FOREIGN PATENT DOCUMENTS

| | | | |
|---|---|---|---|
| CA | 2247950 | A1 | 9/1997 |
| WO | WO- 97/03733 | | 2/1997 |

* cited by examiner

PARTIAL CROSS-SECTION ALONG LINE A-A OF FIGURE 1

CROSS-SECTION ALONG LINE 13-13 OF FIGURE 1

BINDING MOUNTING SYSTEM FOR RECREATIONAL BOARD

TECHNICAL FIELD

The invention relates to the field of recreational sports where an individual stands on a rider support surface of a board and rides the board through or atop of a medium such as air, snow or water. In such sports, bindings may be used to retain the individuals feet on the rider support surface. Particular embodiments of the invention relate to binding mounting systems for securing bindings to boards.

BACKGROUND

Many recreational sports, such as snowboarding, for example, involve riding a board through or atop of a medium such as air, snow or water. A rider stands on one surface (the rider support surface) of an elongated snowboard with his or her feet spaced apart from one another and oriented at an angle with respect to the longitudinal axis of the snowboard. The rider rides the board down snow covered inclined slopes with one foot in front of the other in a manner similar to that of surfing. Depending on whether the rider puts their right foot forward or their left foot forward, the rider's stance defines one edge of the snowboard to be the "heel side" (i.e. the edge of the board closest to the rider's heels) and one edge of the snowboard to be the "toe side" (i.e. the edge of the board closest to the rider's toes).

Snowboards typically incorporate bindings which increase the rider's control over the board. Bindings retain the rider's feet on the rider support surface of the board, such that the rider's feet do not move significantly relative to the board. There are many types of snowboard bindings in use today. The most common type of binding, referred to as a "high back" binding, incorporates a back member which projects from a binding base plate on the rider support surface, such that the rider may lean backward to apply pressure to the heel side of the board, and one or more straps which extend over top of the foot and bind the foot to the binding base plate, such that the rider may lean forward to apply pressure to the toe side of the board. Another common type of binding, referred to as the "step-in" binding, requires that the rider wear a hard shell boot which is secured to the binding base plate, such that the rider can apply pressure to the heel and toe sides of the snowboard. Step-in bindings use a variety of techniques for securing the hard shell boot to the binding base plate.

For different events, different types of snowboarding and/or different snowboarding conditions, it is desirable for a rider to be able to adjust his or her stance (i.e. the position and orientation of his or her feet relative to the support surface of the board). For example, during speed runs, such as giant slalom, a rider may prefer to have both of his or her feet oriented at small angles relative to the longitudinal axis of the board, whereas for free snowboarding, a rider may prefer to have one or both of his or her feet oriented at an angle that is large relative to the longitudinal axis of the board. As another example, when the snowboarding conditions are such that the snow is deep or heavy, a rider may want to have their feet relatively close to the back of the board, whereas, when the snowboarding conditions are such that the snow is less deep or less heavy, a rider may want to position their feet closer to the front of the snowboard. It is also desirable for snowboard rental shops, snowboard equipment retailers or the like to be able to adjust the bindings of a particular snowboard and binding system to accommodate the stance of different riders.

Adjustment of the stance of a rider typically involves adjustment of the angular orientation of a rider's foot (or feet) relative to the longitudinal axis of the snowboard and/or adjustment of the position of a rider's foot (or feet) along the longitudinal axis of the snowboard. Since the rider's feet are fixed to the board by bindings, adjustment of a rider's stance typically involves adjusting the angular orientation of the binding(s) relative to the longitudinal axis of the snowboard and/or adjustment of the position of the binding(s) along the longitudinal axis of the snowboard.

In typical snowboards, adjustment of the orientation and position of the bindings relative to the longitudinal axis of the snowboard is facilitated by binding mounting systems. Binding mounting systems are used to couple the bindings to the snowboard. The most common binding mounting systems in use today make use of a plurality of spaced apart threaded holes which extend from the rider support surface into the board. A plurality (e.g. three or four) retaining bolts project through a binding retaining disc (used to hold down the binding base plate) and into a set of the threaded holes to secure the binding to the board.

These binding mounting systems have the drawback that adjustment of the longitudinal position of the binding(s) is limited to a small number of discrete positions. Typically, each binding may only be located at about 3 or 4 longitudinal positions (i.e. corresponding to the discrete positions of the sets of threaded holes). Another drawback with this type of binding mounting system is that adjustment of the longitudinal position requires that the retaining bolts be completely removed from their current set of threaded holes and inserted into a new set of threaded holes. The complete removal and reinsertion of the bolts into a new set of threaded holes may be difficult, especially as a field operation, where the bolts may be lost in the snow and the new set of threaded holes may be filled with snow.

Various embodiments of a binding mounting system have been proposed by Carlson in U.S. Pat. Nos. 6,015,161 and 6,189,899 and in published Unites States Patent application No. 2001/0038182. The Carlson binding mounting system incorporates a specialized board having front and back channels which extend longitudinally along the centerline of the board. Front and back bindings are respectively mounted to the front and back channels. Each binding has a base plate and a disc. The disc has a centerline and a bottom surface that is rotatably coupled to the binding base plate. A rail is disposed within and fixedly coupled to the channel. The rail is made of flexible material and comprises two series of parallel notches. Corresponding notches on the centerline of the bottom of the disc engage the rail. A locking mechanism couples the disc to the binding and the binding to the board.

Because the rail of the Carlson binding mounting system is flexible, it is correspondingly weak. Under the high stresses and forces applied by riders, the Carlson binding mounting system may deform to permit movement of the binding relative to the snowboard. In addition, the locking mechanisms proposed by Carlson do not have the coupling strength associated with conventional threaded fasteners. Accordingly, the relatively large forces and high torques imparted by a rider's feet during snowboarding may cause the locking mechanism to slip, break, unlock or loosen over time and may cause corresponding movement of the binding with respect to the snowboard. Another drawback with the Carlson binding mounting system is that it does not permit the longitudinal position and angular orientation of the bindings to be separately and independently adjusted.

A snowboard binding mounting system proposed by Quattro et al. in published United States Patent Application No. 2003/0116931 comprises a specialized board having front and rear pairs of parallel, longitudinally extending channels formed in the snowboard. Each pair of channels corresponds to one of the front and rear bindings. The upper surface of each channel comprises a channel element having transversely extending teeth that face downwardly into the channel. Each channel accepts a channel insert having an elongated element that extends between a pair of round elements. Each round element of each channel insert incorporates transversely extending teeth on its upper surface (for engaging corresponding teeth of the channel element) and a threaded hole. Bolts extend through slots in a binding retaining disc and are coupled to the threaded holes of the channel inserts. When the bolts are tightened, the transversely extending teeth of the channel insert engage the corresponding teeth of the channel element and the binding retaining disc engages a binding base plate.

The Quattro binding mounting system requires a pair of channels for each binding, which significantly reduces the structural integrity of the snowboard, especially when the channels are widened to accommodate the transversely extending ridges on the channel element and the channel insert. In addition, the Quattro binding mounting system does not permit the longitudinal position and angular orientation of the bindings to be separately and independently adjusted.

There is a general desire for binding mounting systems which facilitate adjustment of a rider's stance and which ameliorate at least some of the aforementioned or other disadvantages with the prior art systems.

SUMMARY OF THE INVENTION

A first aspect of the invention provides a system for mounting a binding to a recreational board. The system comprises a recreational board having a longitudinally extending chamber, a slider assembly and a binding assembly. The slider assembly comprises a slider member positionable such that at least a portion of the slider member is located within the chamber and a slider retaining mechanism for engaging the slider member. The slider assembly is adjustable to a first configuration wherein the slider member is longitudinally moveable relative to the chamber and to a second configuration wherein the slider member is fixed relative to the chamber. The binding assembly comprises a binding positionable atop a rider support surface of the board and a binding retaining mechanism for engaging the slider assembly to couple the binding thereto. The binding assembly is adjustable to a first configuration wherein an angular orientation of the binding is adjustable relative to the board and to a second configuration wherein the angular orientation of the binding is fixed relative to the board.

The binding assembly may be adjustable between its first and second configurations while the slider assembly is in its second configuration. The slider assembly may be adjustable between its first and second configurations while the binding assembly is in its second configuration.

Another aspect of the invention provides a system for mounting a binding to a recreational board. The system comprises a recreational board having a longitudinally extending chamber, a slider assembly and a binding assembly. The slider assembly comprises a slider member positionable such that at least a portion of the slider member is located within the chamber and a slider retaining member positionable on a rider support surface of the board and engageable with the slider member. The binding assembly comprises a binding base plate positionable atop the rider support surface and a binding retaining member positionable atop the binding base plate and coupleable to at least one of: the slider retaining member and the slider member.

The slider assembly may comprise a slider retaining mechanism for coupling the slider retaining member to the slider member. The slider retaining mechanism may be adjustable to a first configuration where the slider member is longitudinally moveable relative to the chamber and a second configuration where a longitudinal position of the slider member is fixed relative to the chamber.

The binding assembly may comprises a binding retaining mechanism for coupling the binding retaining member to at least one of: the slider retaining member and the slider member. The binding retaining mechanism may be adjustable to a first configuration where an angular orientation of the binding base plate is adjustable relative to the board and a second configuration where the angular orientation of the binding base plate is fixed relative to the board.

Another aspect of the invention provides a system for mounting a binding to a recreational board. The system comprises a recreational board having a longitudinally extending chamber, a slider member positionable such that at least a portion of the slider member is located within the chamber and a slider retaining member positionable adjacent to the chamber and engageable with the slider member. A binding comprising a binding base plate is positionable atop a rider support surface of the board. A binding retaining member is positionable atop the binding base plate and is coupleable to at least one of: the slider member and the slider retaining member.

Further features and applications of specific embodiments of the invention are described below.

BRIEF DESCRIPTION OF THE DRAWINGS

In drawings which depict non-limiting embodiments of the invention.

DETAILED DESCRIPTION

Figure 1:
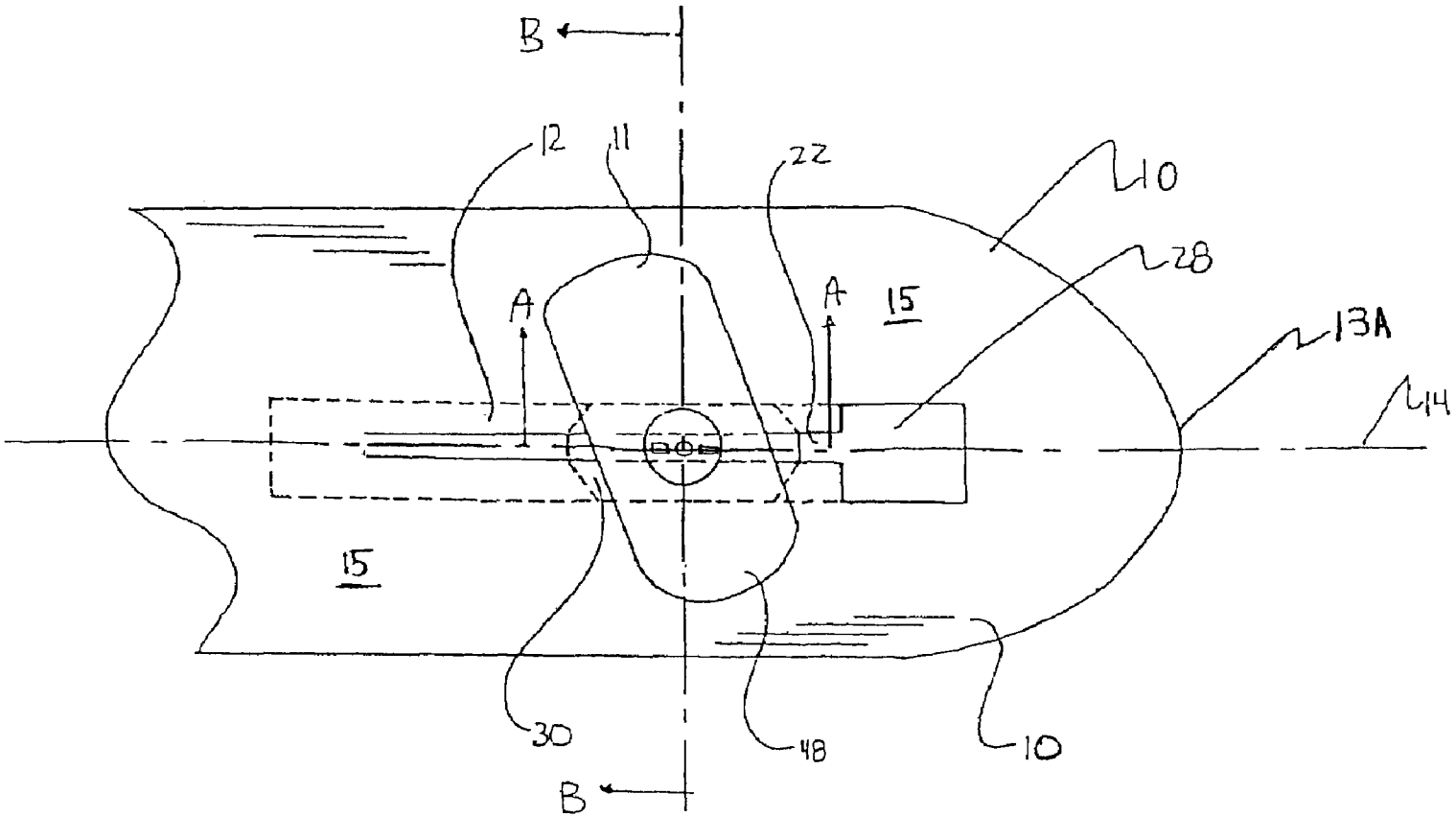
FIG. 1 is a top view of a portion of a recreational board and a portion of a binding which may accommodate the binding mounting systems of the invention.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Aspects of this invention provide binding mounting systems for recreational boards. A board comprises a longitudinally extending chamber corresponding to each binding. The binding mounting system comprises a slider assembly. The slider assembly includes a slider member, at least a portion of which is disposed to move longitudinally within the chamber, and a slider retaining mechanism, which engages the slider member. The slider assembly is adjustable to a first configuration wherein the slider member is longitudinally moveable relative to the chamber and a second configuration wherein the slider member is fixed relative to the chamber. A binding assembly comprises a binding and a binding retaining mechanism. The binding is positioned atop a rider support surface of the board. The binding retaining mechanism engages the slider assembly to couple the binding thereto. The binding assembly is adjustable to a first configuration wherein an angular orientation of the binding is adjustable relative to the board and to a second configuration wherein the angular orientation of the binding is fixed relative to the board. Preferably, the binding assembly is adjustable between its first and second configurations while the slider assembly is in its second configuration (i.e. such that the angular orientation of the binding may be adjusted separately and independently from the longitudinal position of the binding). Preferably, the slider assembly is adjustable between its first and second configurations while the binding assembly is in its second configuration (i.e. such that the longitudinal position of the binding may be adjusted separately and independently from the angular orientation of the binding).

In some embodiments, the chamber comprises one or more shoulders which have downwardly facing, transversely extending ridges located thereon and the slider member comprises corresponding upwardly facing, transversely extending ridges for engaging the downwardly facing, transversely extending ridges of the chamber when the slider assembly is in its second configuration. In some embodiments, the slider retaining mechanism comprises a slider retaining member, which is positioned on the rider support surface of the board, and one or more fastener components. The slider member may comprise one or more corresponding fastener components. The fastener components may be operable to couple the slider member to the slider retaining member.

In some embodiments, the binding retaining mechanism comprises a binding retaining member, which is positioned atop a portion of the binding, and one or more fastener components. In some embodiments, the binding retaining mechanism engages the slider member. In other embodiments, the binding retaining mechanism engages the slider retaining mechanism. The slider member and/or the slider retaining mechanism may comprise one or more corresponding fastener components. The fastener components may be operable to couple the binding retaining member to the slider member and/or the slider retaining mechanism. Preferably, the binding retaining member comprises one or more apertures, for providing access to the slider assembly. Preferably, the binding retaining member has a substantially circular perimeter (i.e. is disc-shaped).

In some embodiments, the binding retaining member comprises a recessed region and the slider retaining mechanism extends upwardly from the rider support surface of the board into the recessed region. In some embodiments, the binding comprises a recessed region and the slider retaining mechanism extends upwardly from the rider support surface of the board into the recessed region.

In some embodiments, the binding retaining member comprises downwardly facing ridges on an undersurface thereof and the binding comprises corresponding upwardly facing ridges for engaging the downwardly facing ridges of the binding retaining member when the binding assembly is in its second configuration. The ridges on the binding retaining member and/or the binding may comprise annular zone(s) of radially extending ridges. The annular zone(s) of ridges may be chamfered.

In some embodiments, the slider retaining mechanism comprises upwardly facing ridges and the binding comprises corresponding downwardly facing ridges for engaging the upwardly facing ridges of the slider retaining mechanism when the binding assembly is in its second configuration. The ridges on the slider retaining mechanism and/or the binding may comprise annular zone(s) of radially extending ridges. The annular zone(s) of ridges may be chamfered.

In some embodiments, the fastener components may be threaded fasteners. In other embodiments, the fastener components may comprise parts of other types of fasteners. In some embodiments, one or more fastener components may be part of both the slider assembly and the binding assembly.

FIGS. 1-9 depict a binding mounting system according to a particular embodiment of the invention. FIG. 1 is a top view of a front portion of a recreational board 10 having a binding 11 mounted to a rider support surface 15 thereof. Recreational board 10 may be a snowboard or some other type of recreational board. Binding 11 comprises a binding base plate 48 which extends along rider support surface 15 to form at least a portion of the base of binding 11. Binding 11 typically also comprises a number of other parts which are well known to those skilled in the art of recreational boards. In order to simplify the explanation of the invention, these other parts of binding 11 are not shown in the drawings. FIG. 1 shows only a front binding 11 (i.e. the binding closest to the front 13A of board 10). Those skilled in the art will appreciate that snowboards typically comprise a pair of bindings and that the binding system of the back binding may be substantially similar to the binding system of the front binding.

This description and the accompanying claims use a number of directional conventions to clarify their meaning:

(i) "front", "forward", "forwadly", "forwardmost" and similar words are used to refer to directions that are generally oriented towards the front 13A of board 10 (FIG. 1);

(ii) "back", "backward", "rear", "rearward", "rearwardly", "rearwardmost" and similar words are used to refer to directions that are generally oriented away from the front 13A of board 10 (i.e. opposite the forward direction);

(iii) "longitudinal" and "longitudinally" and similar words are used to refer to either or both of the forward and rearward directions;

(iv) "transverse", "transversely", "side", "sideways" and similar words refer to directions that are generally orthogonal to the longitudinal direction and generally in the plane of snowboard 10;

(v) "up", "upper", "upward", "upwardly", "upwardmost" and similar words are used to refer to a direction that extends from a center of board 10 towards rider support surface 15 and beyond (i.e. out of the page toward the reader in FIG. 1);

(vi) "low", "lower", "down", "downward", "downwardly", "downwardmost" and similar words refer to a direction that is opposite the upward direction; and (vii)"vertical", "vertically" or similar words refer to either or both of the upward and downward directions.

Those skilled in the art will appreciate that directional conventions used in this description and the accompanying claims depend on the specific orientation of board 10 and bindings 11. Accordingly, these directional terms are not strictly defined and should not be interpreted narrowly.

Figure 3:
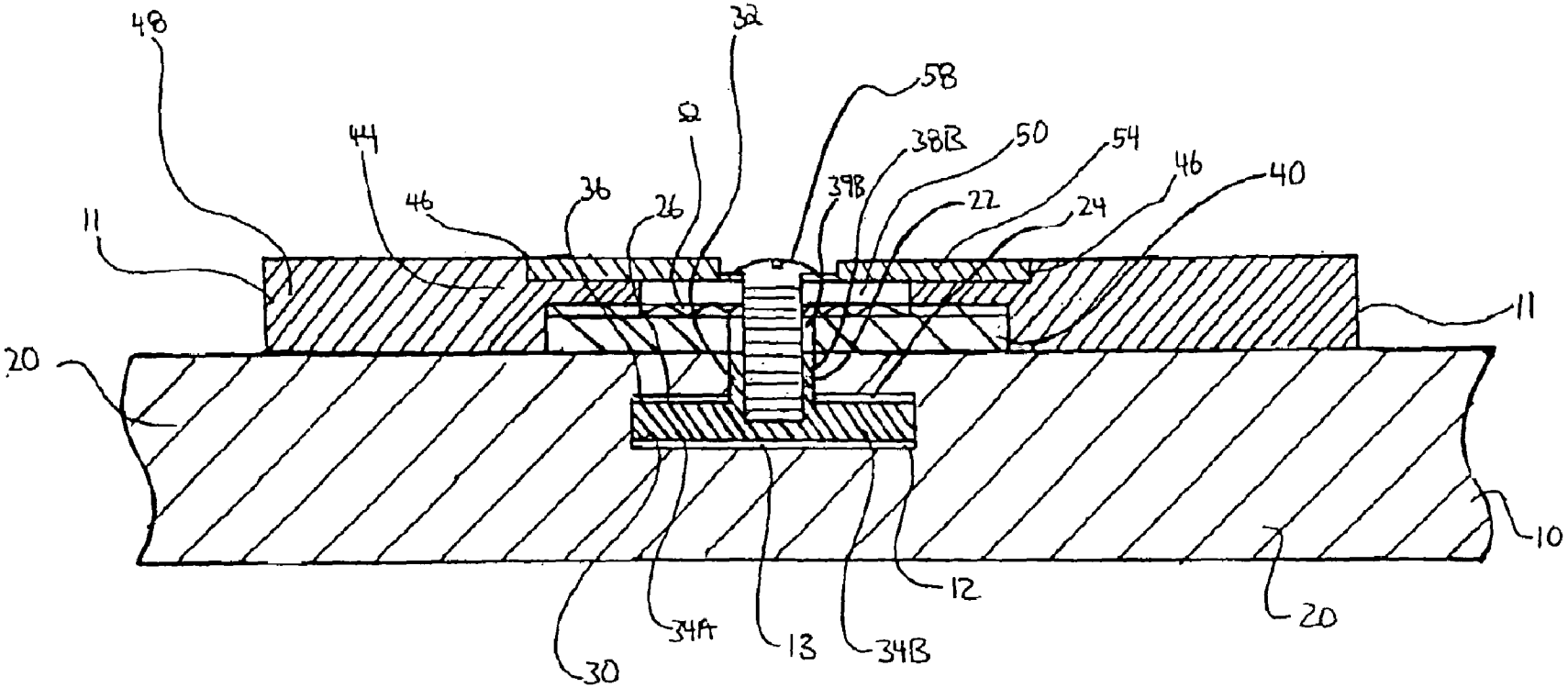
FIG. 3 is a partial cross-section along the line B-B (FIG. 1) of the FIG. 2 binding mounting system.
Figure 5:
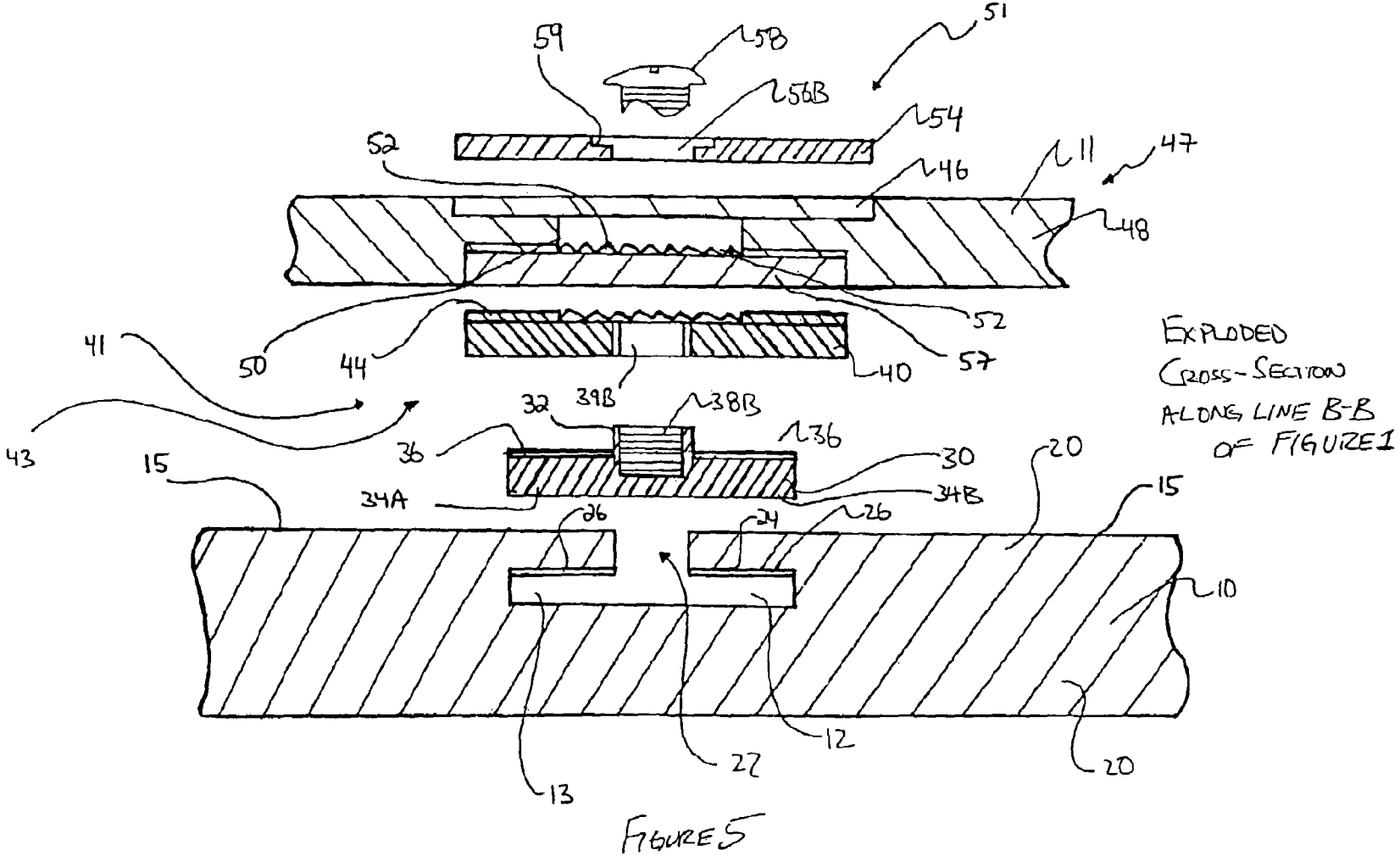
FIG. 5 is an exploded partial cross-section along the line B-B (FIG. 1) of the FIG. 2 binding mounting system.

Snowboard 10 incorporates a chamber 12 which is elongated in a direction parallel with the longitudinal axis 14 of snowboard 10. Preferably, chamber 12 is centered on the transverse dimension of board 10 and extends along longitudinal axis 14. As is known in the art, snowboard 10 may be fabricated from a number of thin layers (individual layers not shown) of various material(s) 20. Chamber 12 may be formed between such layers. In the illustrated embodiments, a lower portion 13 of chamber 12 is generally rectangular in its transverse cross-section (FIGS. 3 and 5). Chamber 12 also includes a slot 22 which opens upwardly onto rider support surface 15. As shown in FIGS. 3 and 5, the transverse dimension of slot 22 is narrower than the transverse dimension of lower portion 13 of chamber 12 to form shoulders 24 on the downwardly facing inner surfaces of chamber 12. Preferably, as shown in FIG. 1, slot 22 includes an opening 28 with a larger transverse dimension at one of its front or rear ends.

Figure 2:
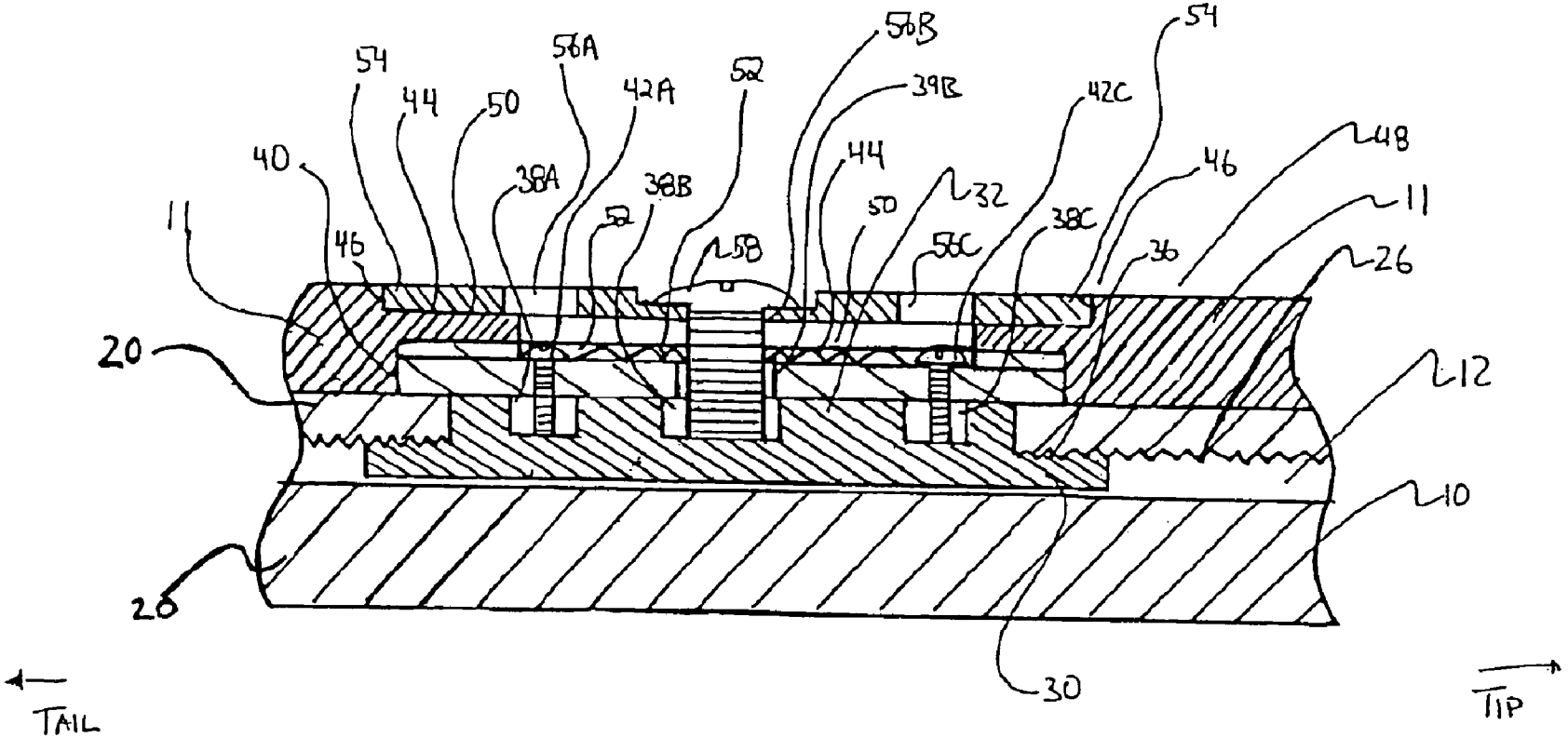
FIG. 2 is a partial cross-section along the line A-A (FIG. 1) of a binding mounting system according to a particular embodiment of the invention.
Figure 4:
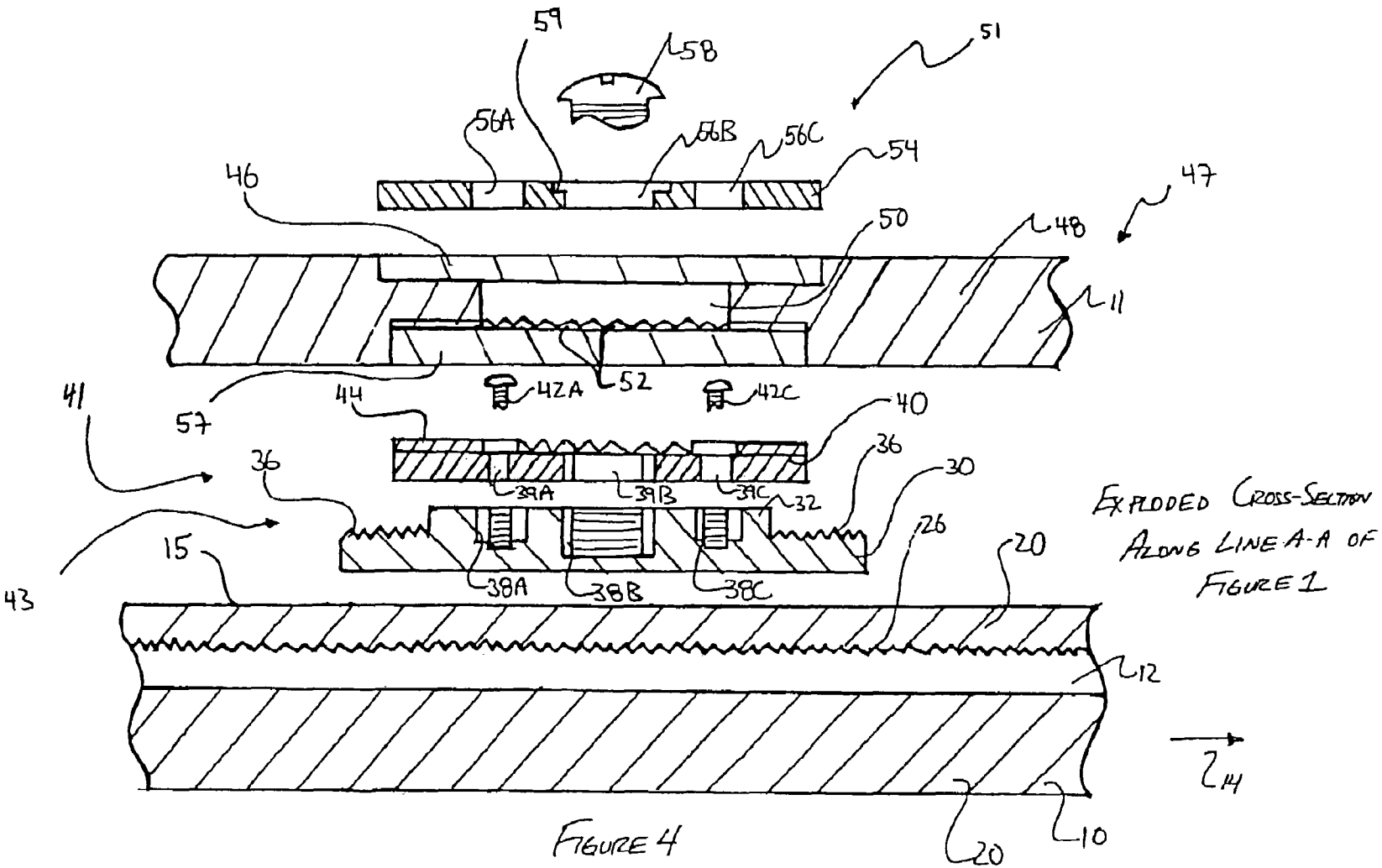
FIG. 4 is an exploded partial cross-section along the line A-A (FIG. 1) of the FIG. 2 binding mounting system.
Figure 9:
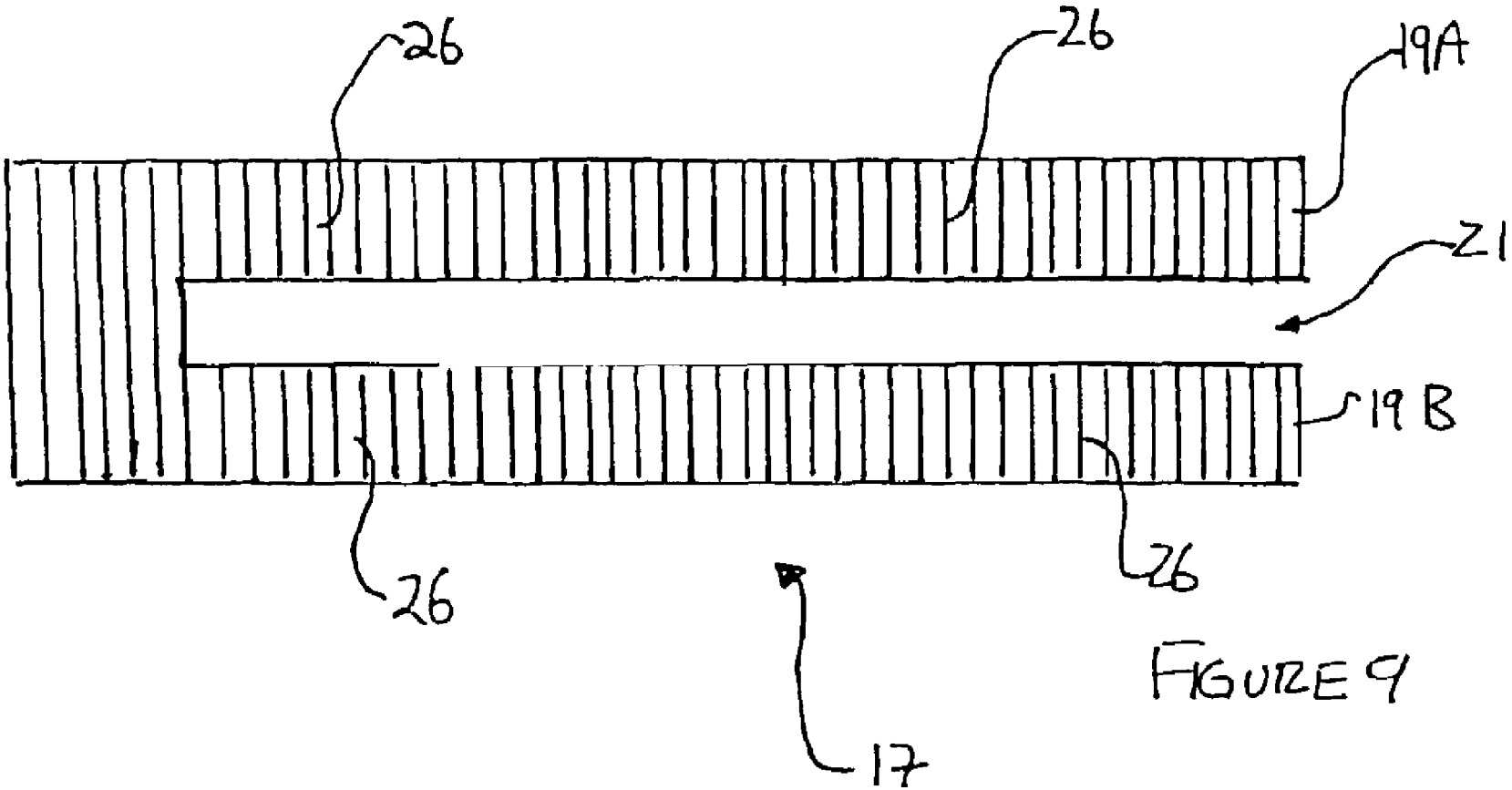
FIG. 9 is bottom view of an insert for providing downwardly facing transverse ridges on the chamber of the FIG. 2 binding mounting system in accordance with a particular embodiment of the invention.
Figure 10:
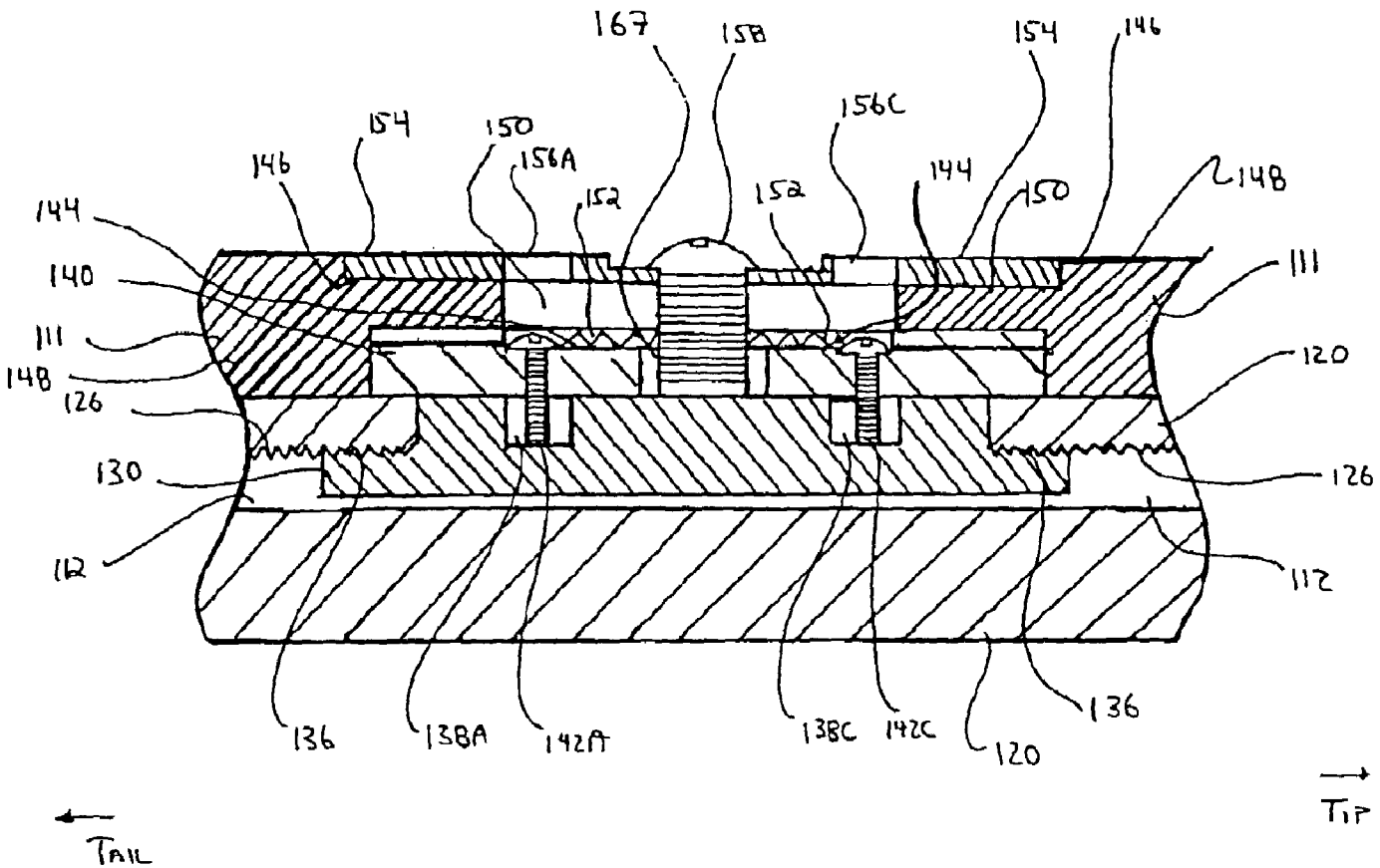
FIG. 10 is a partial cross-section along the line A-A (FIG. 1) of a binding mounting system according to another embodiment of the invention.
Figure 11:
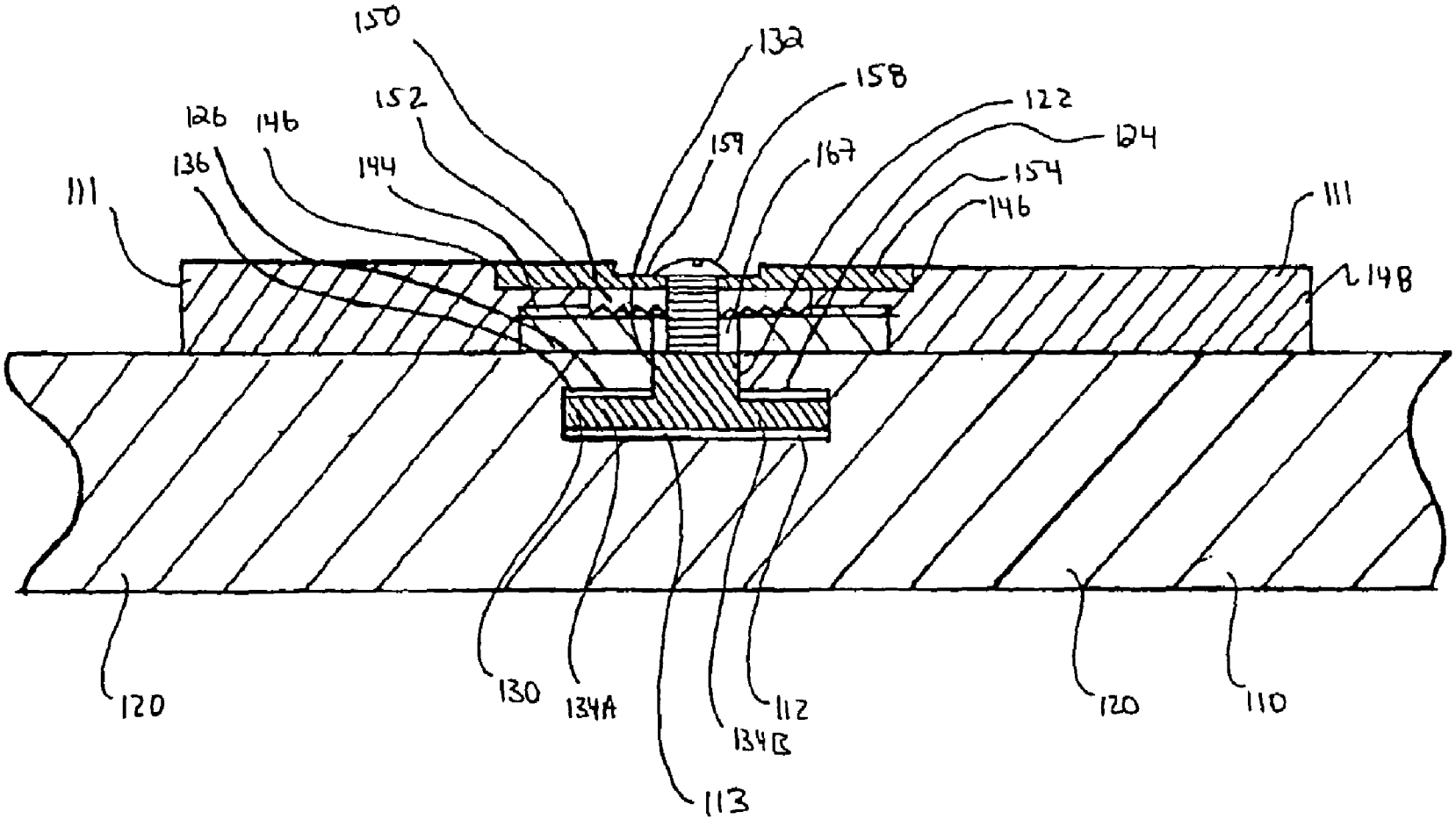
FIG. 11 is a partial cross-section along the line B-B (FIG. 1) of the FIG. 10 binding mounting system.
Figure 12:
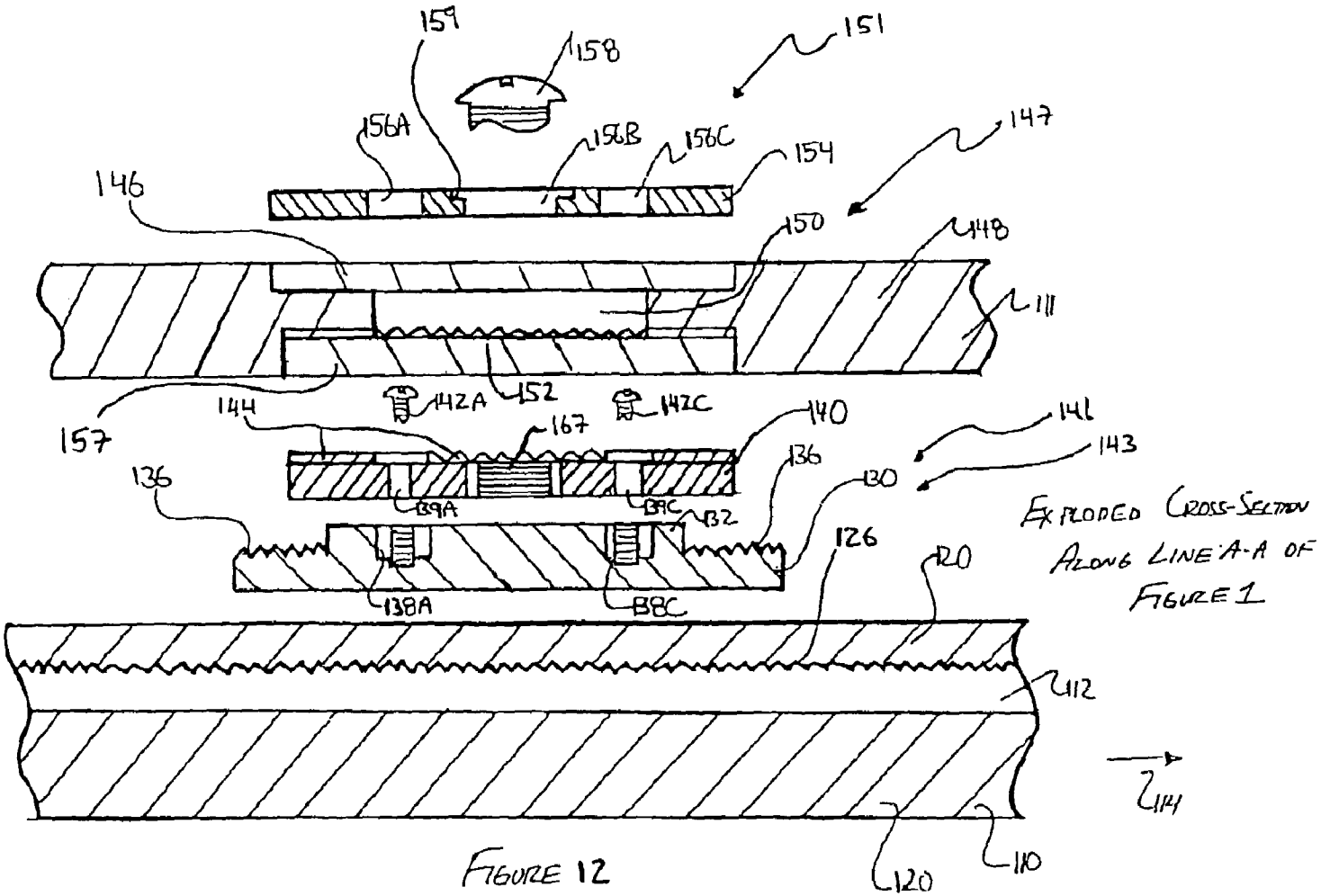
FIG. 12 is an exploded partial cross-section along the line A-A (FIG. 1) of the FIG. 10 binding mounting system.
Figure 13:
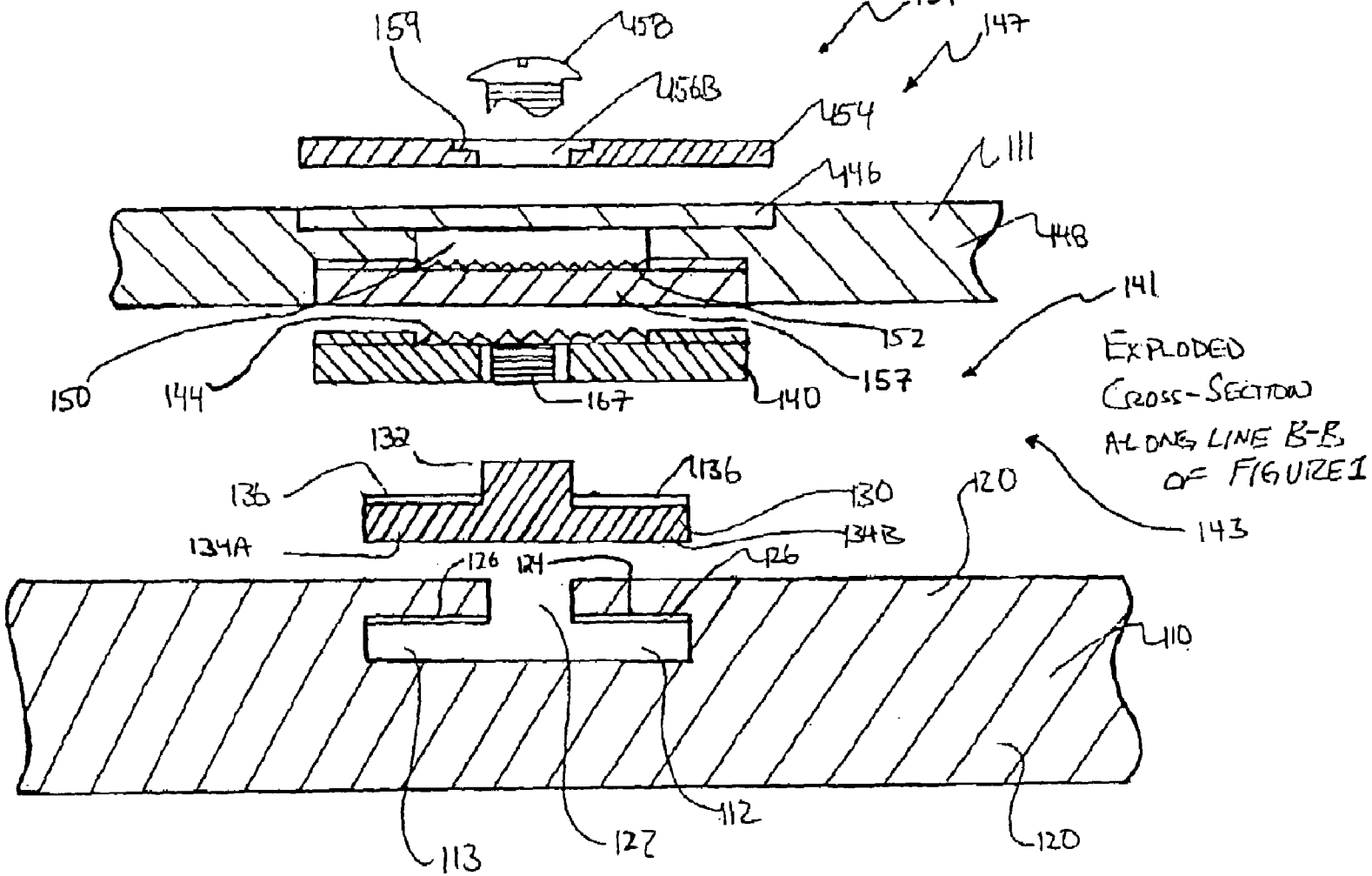
FIG. 13 is an exploded partial cross-section along the line B-B (FIG. 1) of the FIG. 10 binding mounting system.

The undersurfaces of shoulders 24 face downwardly into chamber 12 and may be provided with downwardly facing, transversely extending ridges 26 (FIGS. 2 and 4). In some embodiments, shoulders 24 comprises 1-20 transverse ridges 26 per centimeter. In preferred embodiments, shoulders 24 comprise 2-10 transverse ridges 26 per centimeter. In some embodiments, ridges 26 are provided by a chamber insert which is coupled to shoulders 24 of chamber 12. A bottom view of a suitable insert 17 is depicted in FIG. 9. Insert 17 comprises a pair of fingers 19A, 19B and is open at one end 21. Open end 21 is oriented towards the larger dimensioned opening 28 of slot 22 (FIG. 1).

The downward facing surface of insert 17 is preferably fabricated with transversely extending ridges 26. In other embodiments, transversely extending ridges 26 are machined or otherwise formed on the bottom surface of insert 17 after its fabrication. Insert 17 may be coupled to shoulders 24 using a suitable adhesive or any other coupling technique. Insert 17 may be coupled to shoulders 24 during the fabrication of board 10 (i.e. prior to the assembly of all of the layers of board 10). Alternatively, insert 17 may be inserted through opening 28 and coupled to shoulders 24 after the fabrication of board 10. Ridges 26 of insert 17 may be made from steel, some other metal or some suitably rigid and strong plastic or plastic composite material. In other embodiments, a separate insert is not required and transverse ridges 26 are formed by patterning ridges 26 into one or more layers of board 10 during fabrication.

The binding mounting system shown in FIGS. 1-9 includes a slider assembly 43 and a binding assembly 47. Slider assembly 43 comprises a slider member 30 (see FIGS. 4 and 5), at least a portion of which is located in chamber 12 (FIGS. 2-5). In some embodiments, slider member 30 is located in chamber 12 during the fabrication of board 10. In other embodiments, slider member 30 is inserted into chamber 12 after fabrication of board 10 through larger dimensioned opening 28. Tn the illustrated embodiment (as shown best in FIGS. 3 and 5), slider member 30 is generally "T-shaped" in transverse cross-section, with an upwardly extending portion 32 and a pair of transversely extending flanges 34A, 34B. Preferably, when slider member 30 is located in chamber 12, upwardly extending portion 32 extends into slot 22 and transversely extending flanges 34A, 34B extend under shoulders 24 (FIG. 3).

Figure 6:
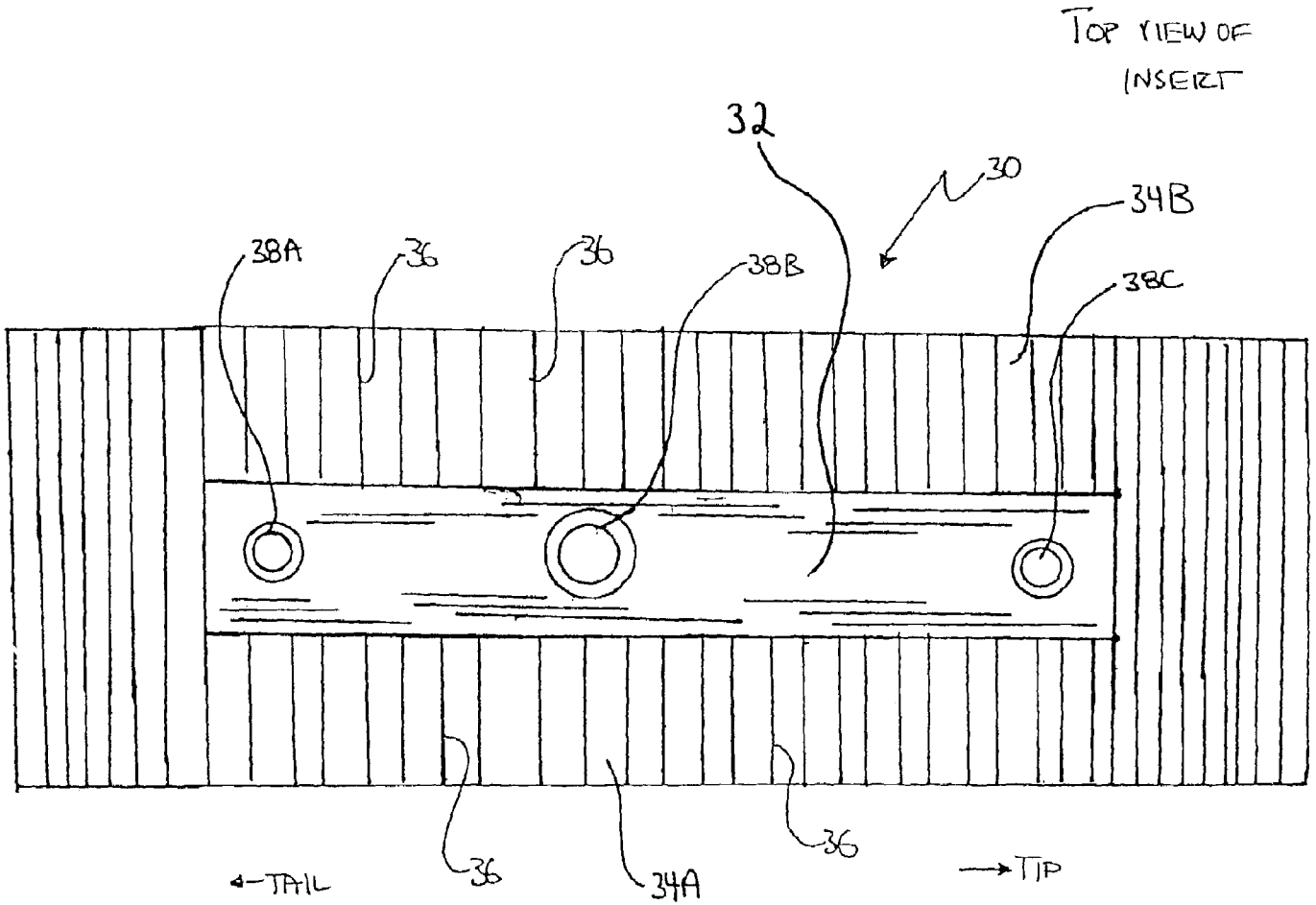
FIG. 6 is a top view of a slider member suitable for use with the FIG. 2 binding mounting system.

As shown best in FIG. 6, the upper surface of each transversely extending flange 34A, 34B may comprise upwardly facing, transversely extending ridges 36. In some embodiments, slider member 30 comprises 1-20 transverse ridges 36 per centimeter to match the spacing of transversely extending ridges 26 on the undersurfaces of shoulders 24. In preferred embodiments, slider member 30 comprises 2-10 transverse ridges 36 per centimeter. Ridges 36 of slider member 30 may be made from steel, some other metal or some suitably rigid and strong plastic or plastic composite material. As explained in greater detail below, when slider member 30 is located in chamber 12, ridges 36 are capable of engaging corresponding transversely extending ridges 26 on the undersurfaces of shoulders 24 to maintain the longitudinal position of slider member 30 (and binding 11) relative to chamber 12 and board 30.

In the embodiment of FIGS. 1-9, slider member 30 includes three fastener components 38A, 38B, 38C (see FIGS. 4 and 6). Preferably, as shown in FIG. 6, fastener components 38A, 38B, 38C are located in the vertically extending portion 32 of slider member 30, such that when slider member 30 is located in chamber 12, fastener components 38A, 38B, 38C are aligned with slot 22 and longitudinal axis 14. In the illustrated embodiment of FIGS. 1-9, fastener components 38A, 38B, 38C comprise threaded holes into which bolts may be threadably fastened. In other embodiments, fastener components 38A, 38B, 38C comprise other types of fastener components, such as bolts, threaded shafts and components of more complex locking mechanisms for example. Fastener components 38A, 38B, 38C are preferably fixed in relation to slider member 30. Fastener components 38A, 38B, 38C may be integrally formed with slider member 30 or may be separate components that are encased in the vertically extending portion 32 of slider member 30. In the illustrated embodiment, central fastener component 38B is larger in cross-section than fastener components 38A, 38C.

Figure 7:
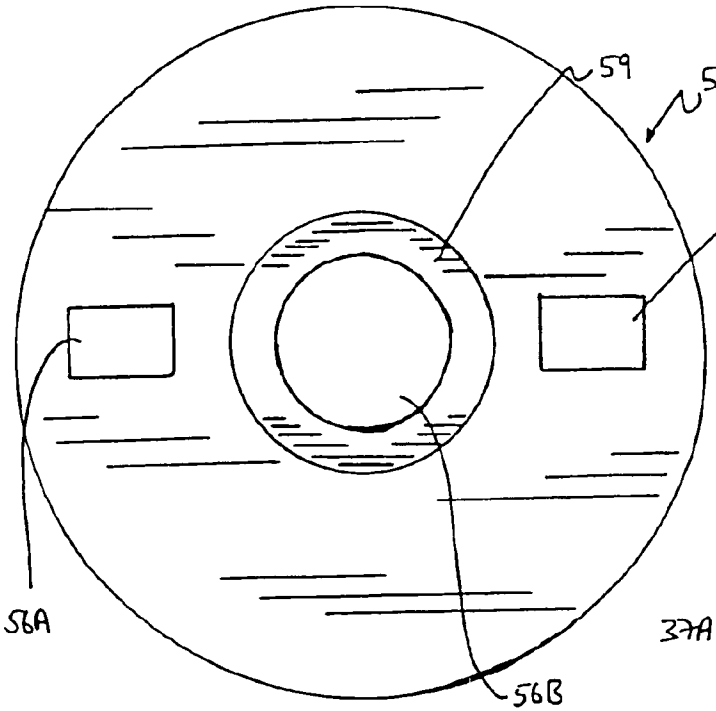
FIG. 7 is a top view of a binding retaining member suitable for use with the FIG. 2 binding mounting system.
Figure 8:
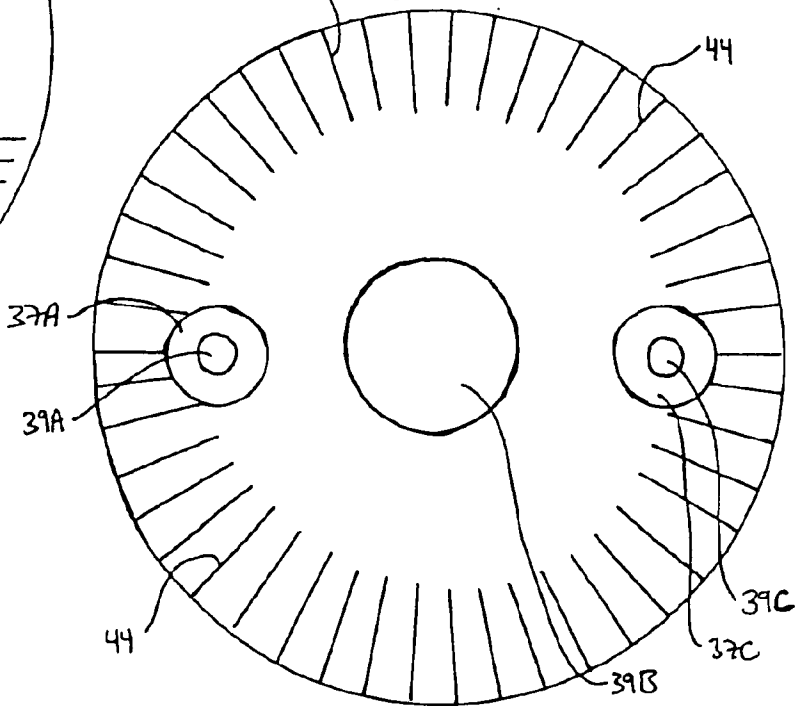
FIG. 8 is a top view of a slider retaining member suitable for use with the FIG. 2 binding mounting system.

Slider assembly 43 of the binding mounting system illustrated in FIGS. 1-9 also comprises a slider retaining mechanism 41 (FIGS. 4 and 5). Slider retaining mechanism 41 comprises a slider retaining member 40 (FIG. 8) and fastener components 42A, 42C. Slider retaining member 40 is positioned atop rider support surface 15 of board 10 and is coupled to slider member 30 (FIGS. 2-5) by fastener components 42A, 42C and corresponding fastener components 38A, 38C. In the embodiment of FIGS. 1-9, slider retaining member 40 is disc-shaped (i.e. with a circular perimeter). In other embodiments, slider retaining member 40 is differently shaped. In the illustrated embodiment of FIGS. 1-9, the upper surface of slider retaining member 40 comprises ridges 44. As shown in FIG. 8, ridges 44 may comprise an annular zone of ridges 44 which extend substantially radially toward the center of the annular region. In some embodiments, the annular zone of radially extending ridges 44 is chamfered. In some embodiments, the upper surface of slider retaining member 40 comprises 0.5-5 radially extending ridges 44 per degree. In preferred embodiments, the upper surface of slider retaining member 40 comprises 1.5-4 radially extending ridges 44 per degree.

Holes 39A, 39B, 39C extend vertically through the body of slider retaining member 40. In some embodiments, one or more of holes 39A, 39B, 39C are internally threaded. As shown best in FIGS. 2-5, fastener components 42A, 42C respectively extend through holes 39A, 39C to engage fastener components 38A, 38C and to couple slider retaining member 40 to slider member 30. In the illustrated embodiment of FIGS. 1-9, fastener components 42A, 42C are bolts which threadably engage the threaded holes of fastener components 38A, 38C. Preferably, slider retaining member 40 has recesses 37A, 37C (FIG. 8) in a region of each of holes 39A, 39C, such that, when tightened to corresponding fastener components 38A, 38C, the heads of fasteners 42A, 42C may be received in recesses 37A, 37C and do not project substantially past the upper surface of slider retaining member 40. In other embodiments, fastener components 42A, 42C comprise other types of fasteners, such as nuts or components of more complex locking mechanisms for example. In other embodiments, fastener components 38A, 38C comprise other types of fasteners, which may project upwardly towards slider retaining member 40 to engage fastener components 42A, 42C.

When fastener components 42A, 42C are tightened to fastener components 38A, 38C, slider retaining member 40 exerts pressure against the rider support surface 15 of board 10 to draw slider member 30 upwardly within chamber 12. When slider member 30 is drawn upwardly in this manner, transverse ridge 36 of slider member 30 engage transverse ridges 26 on shoulders 24 of chamber 12. The engagement of transverse ridges 26 with transverse ridges 36 fixes the longitudinal position of slider member 30 (and binding 11) with respect to chamber 12 and board 10. This configuration represents the second configuration of slider assembly 43.

Binding assembly 47 of the binding mounting system illustrated in FIGS. 1-9 includes a binding 11 (represented in the drawings by binding base plate 48) and a binding retaining mechanism 51. In the embodiment of FIGS. 1-9, a lower surface of binding base plate 48 incorporates a recessed region 57 (FIGS. 4 and 5) that is shaped to conform with slider retaining member 40. At least a portion of recessed region 57 is penetrated by an aperture 50. In the illustrated embodiment of FIGS. 1-9, a region of the lower surface of base plate 48 between the perimeter of aperture 50 and the edge of recessed region 57 comprises a plurality of downwardly facing ridges 52 (FIGS. 4 and 5). Downwardly facing ridges 52 are preferably located in an annular region and preferably extend substantially radially (i.e. toward a center of the annular region). In some embodiments, the annular region of radially extending ridges 52 is chamfered. In some embodiments, binding base plate 48 comprises 0.5-5 downwardly facing radial ridges 52 per degree. In preferred embodiments, binding base plate 48 comprises 1.5-4 downwardly facing radial ridges 52 per degree. In accordance with the binding mounting system of FIGS. 1-9, binding base plate 48 is located atop slider retaining member 40, such that slider retaining member 40 projects from the rider support surface 15 of board 16 into recessed region 57. As explained in more detail below, downward facing ridges 52 of binding base plate 48 engage upward facing ridges 44 of slider retaining member 40 to help maintain the angular orientation of binding 11 with respect to board 10.

Binding retaining mechanism 51 comprises a binding retaining member 54 and fastener component 58. Binding retaining member 54 is placed overtop of binding base plate 48. As shown in FIG. 7, binding retaining member 54 may be disc shaped (i.e. with a circular perimeter). In other embodiments, binding retaining member 54 has other shapes. Preferably, as shown best in FIGS. 4 and 5, the upper surface of binding base plate 48 comprises a recess 46, which is shaped to receive binding retaining member 54 and which is shaped to allow pivotal movement of binding base plate 48 with respect to binding retaining member 48. Apertures 56A, 56B, 56C extend vertically through the body of binding retaining member 54. Apertures 56A, 56B, 56C are aligned with one another and are located above corresponding fastener components 38A, 38B, 38C. In some embodiments, central aperture 56B of binding retaining member 54 is internally threaded. Preferably, outer apertures 56A, 56C are sufficiently large to provide access to fastener components 42A, 42C as discussed further below.

Fastener component 58 is inserted through aperture 56B in binding retaining member 54, through aperture 50 of binding base plate 48 and through hole 39B in slider retaining member 40 and is coupled to fastener component 38B of slider member 30. In the embodiment of FIGS. 1-9, fastener component 58 is a bolt which threadably engages fastener component 38B. Preferably, the upper surface of binding retaining member 54 includes a recessed region 59 (FIG. 7) for receiving the head of fastener component 58, such that when tightened to corresponding fastener component 38B, fastener component 58 does not extend substantially above binding retaining member 54. In other embodiments, fastener component 58 comprises a different type of fastener, such as a nut or a component of a more complex locking mechanism for example. In other embodiments, fastener component 38B comprises a different type of fastener, which may project upwardly towards binding retaining member 54 to engage fastener component 58. In the illustrated embodiment of FIGS. 1-9, when fastener component 58 is tightened to fastener component 38B, binding retaining member 54 forces binding base plate 48 downwardly toward rider support surface 15 and slider retaining member 40, such that downwardly facing ridges 52 on the lower surface of binding base plate 48 engage the upwardly facing ridges 44 on slider retaining member 40 and binding base plate 48 is prevented from rotating relative to slider retaining member 40. This configuration represents the second configuration of binding assembly 47.

The binding mounting system of FIGS. 1-9 permits a person to adjust the angular orientation and longitudinal position of binding 11 with respect to board 10. If a person wishes to adjust the angular orientation of binding 11 with respect to board 10, then they adjust binding assembly 47 to its first configuration wherein the angular orientation of binding 11 is adjustable. More particularly, the person adjusts binding retaining mechanism 51 by loosening fastener component 58 from fastener component 38B. Fastener component 58 is readily accessible to the person from the top of binding retaining member 54. A tool may be used to loosen fastener component 58 from fastener component 38B. When fastener component 58 is loosened from fastener component 38B, binding retaining member 54 is loosened from the upper surface of binding base plate 48 and downwardly facing radial ridges 52 on the lower surface of binding base plate 48 are disengaged from upwardly facing radial ridges 44 on the upper surface of slider retaining member 40. With ridges 52 disengaged from ridges 44, binding base plate 48 (and the rest of binding 11) may be rotated with respect to slider retaining member 40 and board 10.

When the desired angular orientation of binding 11 is achieved, the person adjusts binding assembly 47 to its second configuration wherein the angular orientation of binding 11 is fixed in relation to board 10. More specifically, the person adjusts binding retaining mechanism 51 by re-tightening fastener component 58 to fastener component 38B, such that binding retaining member 54 asserts downward pressure on binding base plate 48 and downwardly facing radial ridges 52 on the lower surface of binding base plate 48 re-engage upwardly facing radial ridges 44 on the upper surface of slider retaining member 40. When ridges 52 re-engage ridges 44, binding base plate 48 is fixed in the desired angular orientation with respect to slider retaining member 40.

Advantageously, the adjustment of the angular orientation of binding 11 with respect to board 10 is separate and independent from the adjustment of the longitudinal position of binding 11. The longitudinal position of binding 11 can remain fixed with respect to board 10 during adjustment of the angular orientation of binding 11, because slider assembly 43 may be maintained in its second configuration wherein slider member 30 (and binding 11) are prevented from moving longitudinally. More particularly, fastener components 42A, 42C may remain tightened to fastener components 38A, 38C, thereby causing slider retaining member 40 to maintain the engagement between upwardly facing transverse ridges 36 on the upper surface of slider member 30 and downwardly facing transverse ridges 26 on shoulders 24 of chamber 12. The engagement of ridges 26 and ridges 36 prevents binding 11 from moving longitudinally.

If a person wishes to adjust the longitudinal position of binding 11 with respect to board 10, then the person adjusts slider assembly 43 to its first configuration wherein slider member 30 is longitudinally moveable relative to chamber 12. More specifically, the person adjusts slider retaining mechanism 41 by loosening fastener components 42A, 58, 42C from fastener components 38A, 38B, 38C. Fastener component 58 is loosened from fastener component 38B as described above. Fastener components 42A, 42C are reached from above binding base plate 48 through the corresponding apertures 56A, 56C in binding retaining member 54. The person may use one or more tools to loosen fastener components 42A, 58, 42C from fastener components 38A, 38B, 38C. When fastener components 42A, 58, 42C are loosened from fastener components 38A, 38B, 38C, slider retaining member 40 is loosened from board 10 and upwardly facing transverse ridges 36 on the upper surface of slider member 30 are disengaged from downwardly facing transverse ridges 26 on shoulders 24 of chamber 12. With ridges 26 disengaged from ridges 36, slider member 30 may be moved longitudinally along chamber 12. Binding 11 moves longitudinally with slider member 30.

When the desired longitudinal position is achieved, the person adjusts slider assembly 43 to its second configuration wherein slider member 30 is longitudinally fixed relative to chamber 12. More specifically, the person adjusts slider retaining mechanism 41 by re-tightening fastener components 42A, 58, 42C to fastener components 38A, 38B, 38C, such that slider retaining member 40 draws slider member 30 upwardly and upwardly facing transverse ridges 36 on slider member 30 re-engage downwardly facing transverse ridges 26 on shoulders 24 of chamber 12. When ridges 26 engage ridges 36, slider member 30 (and binding 11) are locked in their longitudinal positions relative to chamber 12 and board 10.

Binding retaining mechanism 51 also permits simple removal and reinstallation of binding 11 for travel, changing bindings or the like. If a person desires to remove binding 11 from board 10, then they remove fastener component 58 from fastener component 38B. Binding retaining member 54 and binding 11 may then be removed from board 10, leaving a relatively flat board 10 (and slider retaining members 40) for easy storage and transportation. When binding 11 is removed in this way, the longitudinal position of binding 11 is not lost because slider assembly 43 may remain in its second configuration wherein slider member 30 is prevented from moving longitudinally.

FIGS. 10-13 depict a binding mounting system according to another embodiment of the present invention. The binding mounting system of FIGS. 10-13 is suitable for use with binding 11 and board 10 of FIG. 1. In many respects, the binding mounting system of FIGS. 10-13 is similar to the binding mounting system of FIGS. 1-9. Features of the binding mounting system of FIGS. 10-13 are accorded reference numbers that are the same as those of similar features of the binding mounting system of FIGS. 1-9, except that the reference numbers of the binding mounting system of FIGS. 10-13 are preceded by a "1".

The binding mounting system of FIGS. 10-13 differs from the binding mounting system of FIGS. 1-9 in that fastener component 158 (of binding assembly 147 and binding retaining mechanism 151) is coupled to a different part of slider assembly 143. More particularly, fastener component 158 is coupled to fastener component 167 on slider retaining member 140, rather than to slider member 130. In the illustrated embodiment of FIGS. 10-13, fastener component 167 comprises a threaded hole into which bolts may be threadably fastened. In other embodiments, fastener component 167 comprises a different type of fastener component, such as a bolt, a threaded shaft or a component of more complex locking mechanisms for example. In such embodiments, fastener component 167 may project upwardly towards binding retaining member 154. Fastener component 167 is preferably fixed in relation to slider retaining member 140. Fastener component 167 may be integrally formed with slider retaining member 140 or may be encased in a portion of slider retaining member 140. Since fastener component 158 does not engage slider member 130, slider member 130 comprises only two fastener components 138A, 138C. Fastener components 142A, 142C project through holes 139A, 139B to engage fastener components 138A, 138C as described in the embodiment of FIGS. 1-9.

Other components and features of the binding mounting system of FIGS. 10-13 are similar to corresponding components and features of the binding mounting system of FIGS. 1-9 and are not discussed further herein.

The binding mounting system of FIGS. 10-13 is advantageous because it permits separate and independent adjustment of both the angular orientation and the longitudinal position of binding 111 with respect to board 110. Separate and independent adjustment of the angular orientation of binding 111 with respect to board 110 is achieved by adjusting binding assembly 147 to its first configuration wherein the angular orientation of binding 111 is adjustable. More particularly, a person adjusts binding retaining mechanism 151 by loosening fastener component 158 from fastener component 167 to loosen binding retaining member 154 from the upper surface of binding base plate 148 and to disengage downwardly facing radial ridges 152 on the lower surface of binding base plate 148 from upwardly facing radial ridges 144 on the upper surface of slider retaining member 140. With fastener component 158 loosened from fastener component 167, binding base plate 148 (and the rest of binding 111) may be rotated with respect to slider retaining member 140 and board 110. When the desired angular orientation of binding 111 is achieved, the person readjusts binding assembly 147 to its second configuration. More particularly, the person adjusts binding retaining mechanism 151 by re-tightening fastener component 158 to fastener component 167 to re-engage ridges 144 and 152 and to fix the angular orientation of binding base plate 148.

Adjustment of the angular orientation of binding 111 is separate and independent from the adjustment of the longitudinal position of binding 111. The longitudinal position of binding 111 can remain fixed with respect to board 110 during adjustment of the angular orientation of binding 111, because slider assembly 143 may remain in its second configuration wherein slider member 130 (and binding 111) are prevented from moving longitudinally. More particularly, ridges 136 on the upper surface of slider member 130 may remain engaged with ridges 126 on shoulders 124 of chamber 112 such that slider member 130 (and binding 111) are prevented from moving longitudinally.

Separate and independent adjustment of the longitudinal position of binding 111 with respect to board 110 is achieved by adjusting slider assembly 143 to its first configuration wherein slider member 130 is longitudinally moveable relative to chamber 112. More specifically, a person adjusts slider retaining mechanism 141 by loosening fastener components 142A, 142C from fastener components 138A, 138C to disengage upwardly facing transverse ridges 136 on the upper surface of slider member 130 from downwardly facing transverse ridges 126 on shoulders 124 of chamber 112. With ridges 126 disengaged from ridges 136, slider member 130 may be moved along chamber 112 in the direction of longitudinal axis 114 of board 110. Binding 111 moves longitudinally with slider member 130. When the desired longitudinal position is achieved, the person readjusts slider assembly 143 to its second configuration. More particularly, the person adjusts slider retaining mechanism 141 by re-tightening fastener components 142A, 142C to fastener components 138A, 138C, such that upwardly facing transverse ridges 136 re-engage downwardly facing transverse ridges 126 and slider member 130 (and binding 111) are locked in their longitudinal positions relative to chamber 112 and board 110.

Adjustment of the longitudinal position of binding 111 is separate and independent from the adjustment of the angular orientation of binding 111. The angular orientation of binding 111 can remain fixed with respect to board 110 during adjustment of the longitudinal position of binding 111, because binding assembly 147 is maintained in its second configuration wherein binding 111 is prevented from changing its angular orientation. More particularly ridges 144 on the upper surface of slider retaining disc member 140 may remain engaged with ridges 152 on the lower surface of binding base plate 148, such that binding 111 is prevented from changing its angular orientation.

The binding mounting system of FIGS. 10-13 has the same advantages as the binding mounting system of FIGS. 1-9 in respect of removal and installation of bindings 111 for travel, changing the bindings or the like.

FIGS. 14-19 depict a binding mounting system according to another embodiment of the present invention. The binding mounting system of FIGS. 14-19 is suitable for use with binding 11 and board 10 of FIG. 1. In many respects, the binding mounting system of FIGS. 14-19 is similar to the binding mounting system of FIGS. 1-9 and to the binding mounting system of FIGS. 10-13. Features of the binding mounting system of FIGS. 14-19 are accorded reference numbers that are the same as those of similar features of the binding mounting system of FIGS. 1-9, except that the reference numbers of the binding mounting system of FIGS. 14-19 are preceded by a "2".

The binding mounting system of FIGS. 14-19 differs from the binding mounting systems of the previously described embodiments in that slider retaining member 240 is received in a recessed region 271 in binding retaining member 254 and in that binding retaining member 254 comprises downwardly facing ridges 272 for engaging corresponding upwardly facing ridges 274 on binding base plate 248. In the embodiment of FIGS. 14-19, slider retaining member 240 is preferably smaller than aperture 250 in binding base plate 248 such that it can be received in recessed region 271 of binding retaining member 254 as discussed further below. Preferably downwardly facing ridges 272 and upwardly facing ridges 274 comprise annular regions of radially extending ridges. The annular regions of ridges 272 and 274 may be chamfered. One advantage of the binding mounting system of FIGS. 14-19 is that it can be used in conjunction with many of today's common bindings, which comprise binding base plates with upwardly facing, radially oriented ridges and binding retaining discs with corresponding downwardly facing, radially oriented ridges.

Figure 14:
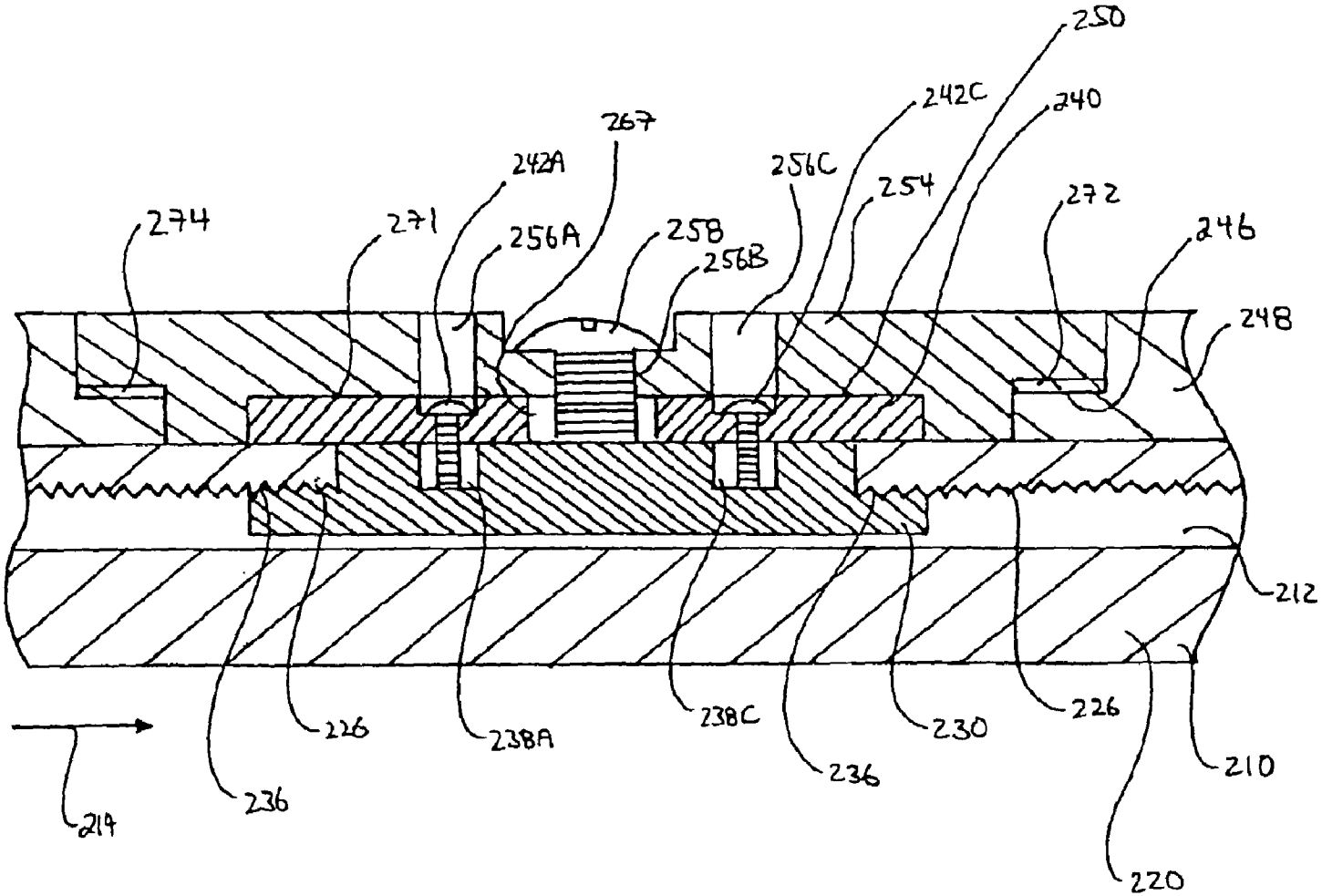
FIG. 14 is a partial cross-section along the line A-A (FIG. 1) of a binding mounting system according to another embodiment of the invention.
Figure 15:
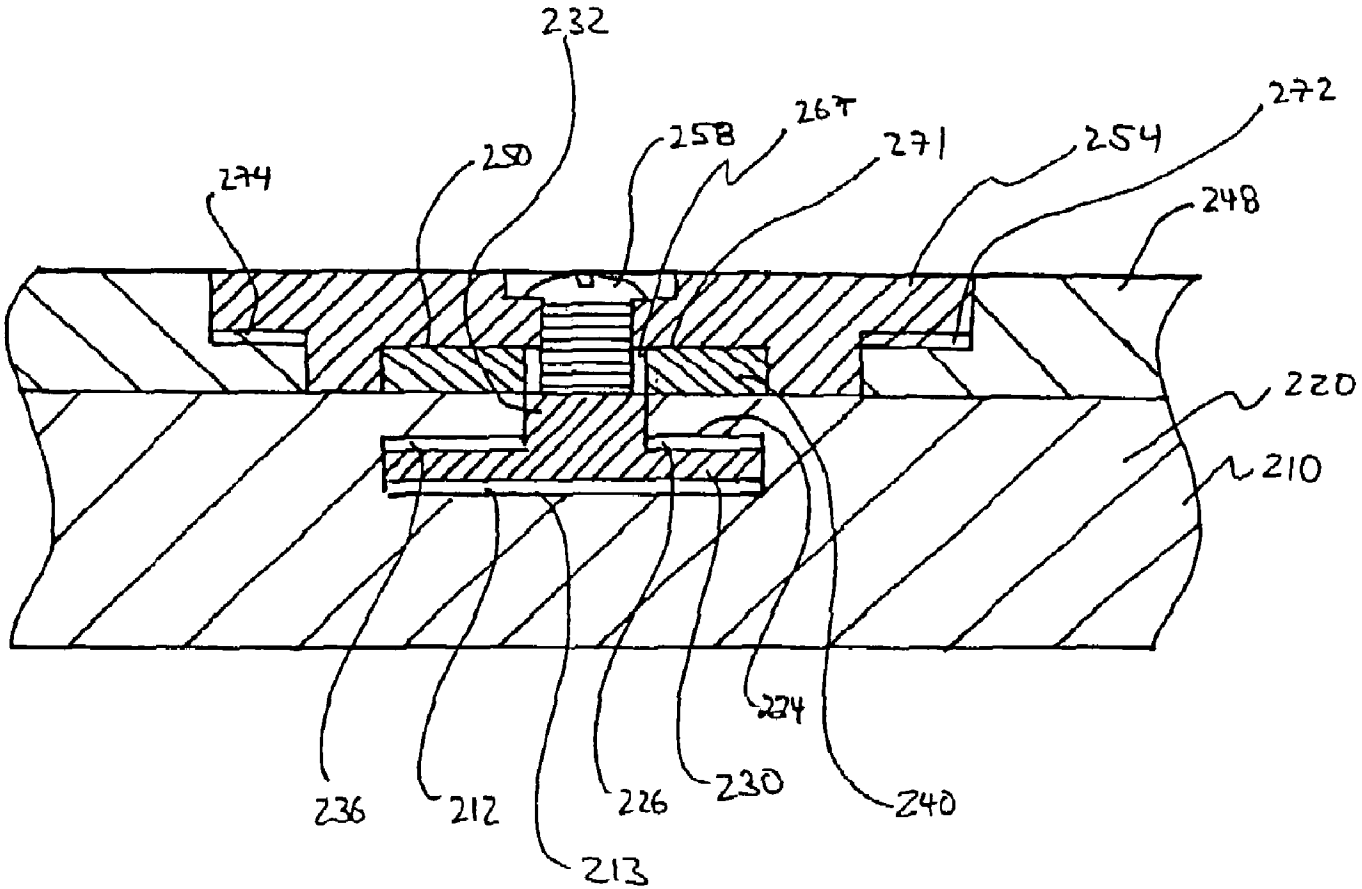
FIG. 15 is a partial cross-section along the line B-B (FIG. 1) of the FIG. 14 binding mounting system.
Figure 16:
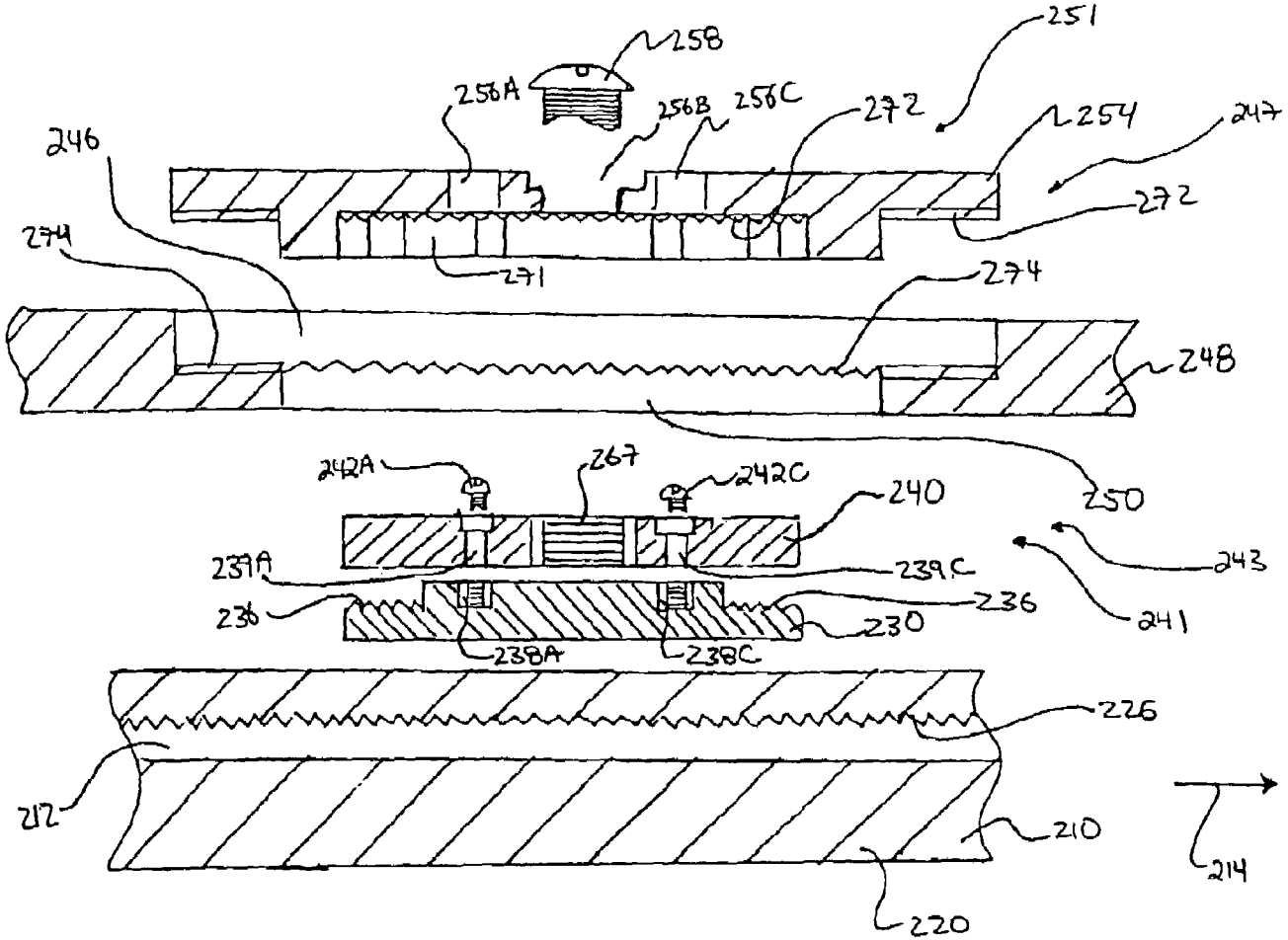
FIG. 16 is an exploded partial cross-section along the line A-A (FIG. 1) of the FIG. 14 binding mounting system.
Figure 17:
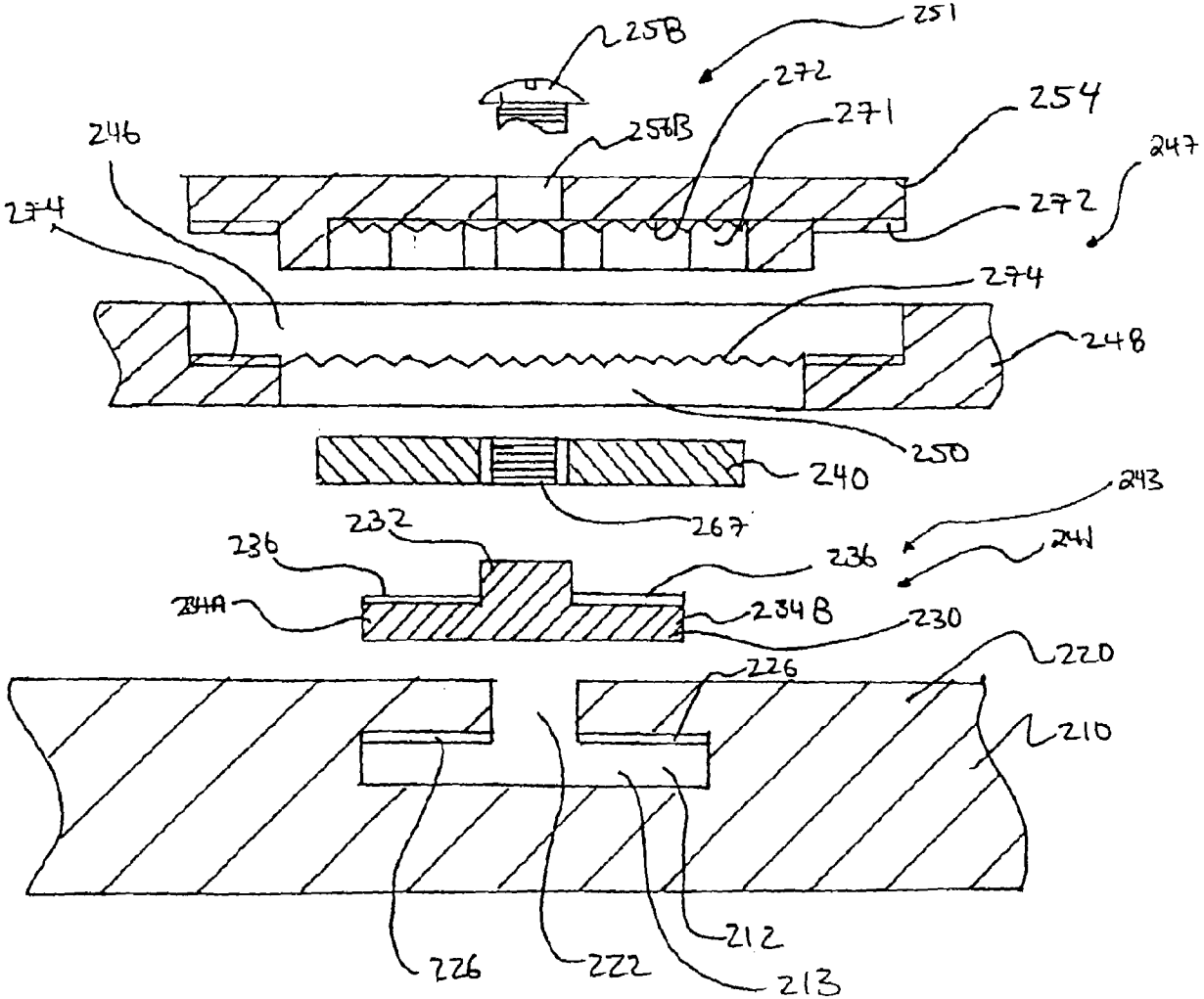
FIG. 17 is an exploded partial cross-section along the line B-B (FIG. 1) of the FIG. 14 binding mounting system.
Figure 18:
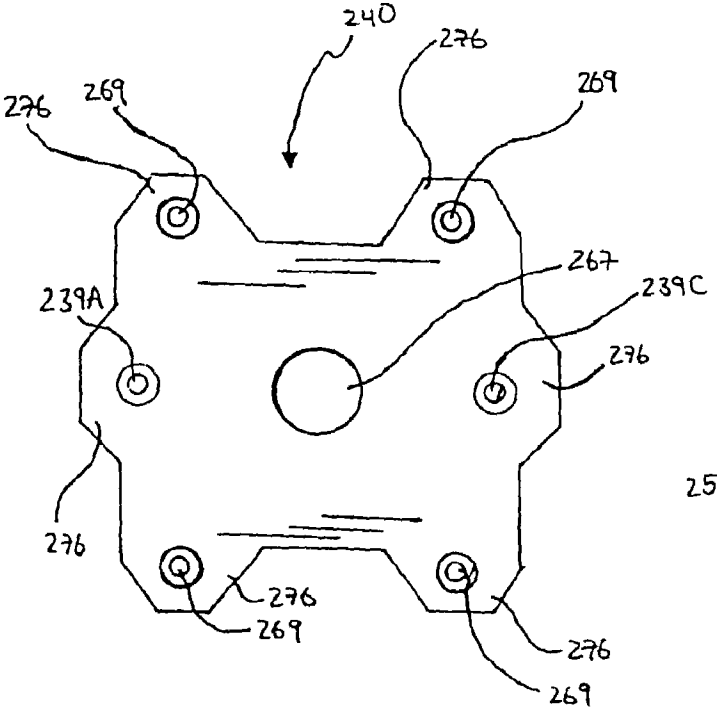
FIG. 18 is a top view of a slider retaining member suitable for use with the binding mounting system of FIG. 14.

FIG. 18 is a top view of slider retaining member 240. Slider retaining member 240 comprises a pair of holes 239A, 239C through which fastener components 242A, 242C may extend to engage corresponding fastener components 238A, 238C in slider member 230 (FIGS. 14 and 16). Fastener components 242A, 242C are tightened to fastener components 238A, 238C to draw slider member 230 upwardly, such that the transversely extending ridges 236 of slider member 230 engage the corresponding transversely extending ridges 226 on shoulders 224 of chamber 212. In the illustrated embodiment of FIGS. 14-19, slider retaining member 240 comprises a fastener component 267 for receiving corresponding fastener component 258 which projects through binding retaining member 254 and binding base plate 248. In this respect, the binding mounting system of FIGS. 14-19 is similar to that of FIGS. 10-13. In other embodiments, slider retaining member 240 comprises a hole and fastener component 258 projects through the hole in slider retaining member 240 to engage a fastener component in slider member 230 (i.e. in the same manner as fastener 58, hole 39B and fastener component 38B of the embodiment illustrated in FIGS. 1-9).

In the illustrated embodiment of FIGS. 14-19, slider retaining member 240 comprises a plurality of optional holes 269. Holes 269 may be threaded. Holes 269 are preferably positioned in locations associated with the threaded holes commonly used in today's binding mounting systems. As discussed above, today's snowboards typically incorporate three or four hole bolt patterns positioned at various locations on the snowboard. Binding mounting systems for use with such snowboards comprise bolts which project through the binding base plate and into these threaded holes. Holes 269 in slider retaining member 240 are preferably positioned to coincide with these three or four bolt patterns, such that binding 211, binding retaining member 254 and/or slider retaining member 240 may also be used with any of a variety of currently existing binding mounting systems.

Figure 19:
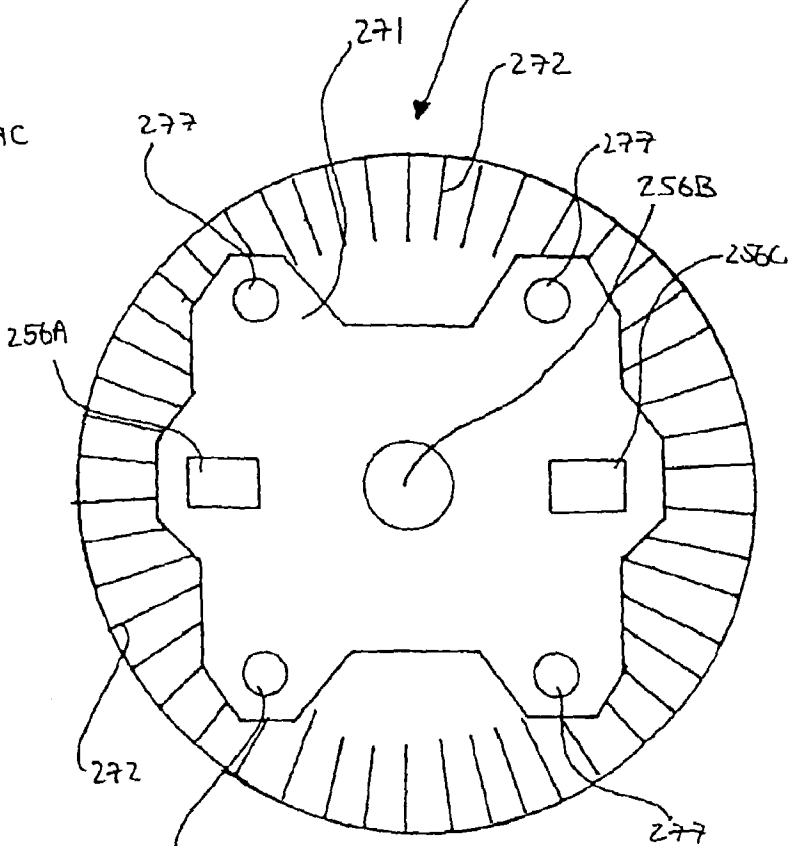
FIG. 19 is a bottom view of a binding retaining member suitable for use with the binding mounting system of FIG. 14.

FIG. 19 shows a bottom view of binding retaining member 254. In the illustrated embodiment, an undersurface of binding retaining member 254 comprises downwardly facing ridges 272. Preferably, ridges 272 extend are located in an annular region and extend in a radial direction (i.e. toward the center of the annular region). In the embodiment of FIGS. 14-19, binding base plate 248 comprises corresponding upwardly facing ridges 274, which are preferably located in an annular region and which are preferably radially extending 274. When fastener component 258 is tightened to fastener component 267 (i.e. binding assembly 247 is in its second configuration), ridges 274 on binding base plate 248 engage ridges 272 on binding retaining member 254 to maintain the angular orientation of binding 211.

As shown in FIG. 19, binding retaining member 254 also comprises a downwardly opening recessed region 271. As shown best in FIGS. 14 and 15, when the binding mounting system of FIGS. 14-19 is assembled, recessed region 271 receives slider retaining member 240. Binding retaining member also comprises optional holes 277. When the binding mounting system of FIGS. 14-19 is assembled, holes 277 are aligned overs hole 269 of slider retaining member 240 to facilitate coupling of binding retaining member 254 to the multi-hole bolt patterns common in today's snowboards.

Other components and features of the binding mounting system of FIGS. 14-19 are similar to corresponding components and features of the binding mounting system of FIGS. 1-9 and are not discussed further herein.

The binding mounting system of FIGS. 14-19 permits separate and independent adjustment of both the angular orientation and the longitudinal position of binding 211 with respect to board 210. Separate and independent adjustment of the angular orientation of binding 211 with respect to board 210 is achieved by adjusting binding assembly 247 between its first configuration, wherein binding base plate 248 (and the rest of binding 211) may be rotated with respect to board 210 and its second configuration wherein binding base plate 248 is fixed with respect to board 210. This is achieved in a manner similar to that of the embodiments described in FIGS. 10-13.

Separate and independent adjustment of the longitudinal position of binding 211 with respect to board 210 is achieved by adjusting slider assembly 243 between its first configuration wherein slider member 230 (and binding 211) may be moved longitudinally along chamber 212 and its second configuration, wherein slider member 230 is fixed with respect to chamber 212 and board 210. This is achieved in a manner similar to that of the embodiment described in FIGS. 10-13.

The binding mounting system of FIGS. 14-19 has the same advantages as the binding mounting system of FIGS. 10-13 in respect of simple removal and reinstallation of bindings 211 for travel, changing the bindings or the like.

In the illustrated embodiment of FIG. 14-19, slider retaining member 240 comprises a plurality of lobes 276. This shape is not necessary for slider retaining member 240. In other embodiments, slider retaining member 240 may have different shapes. Slider retaining member 240 may be disc-shaped or may be rectangular, for example.

Figure 21:
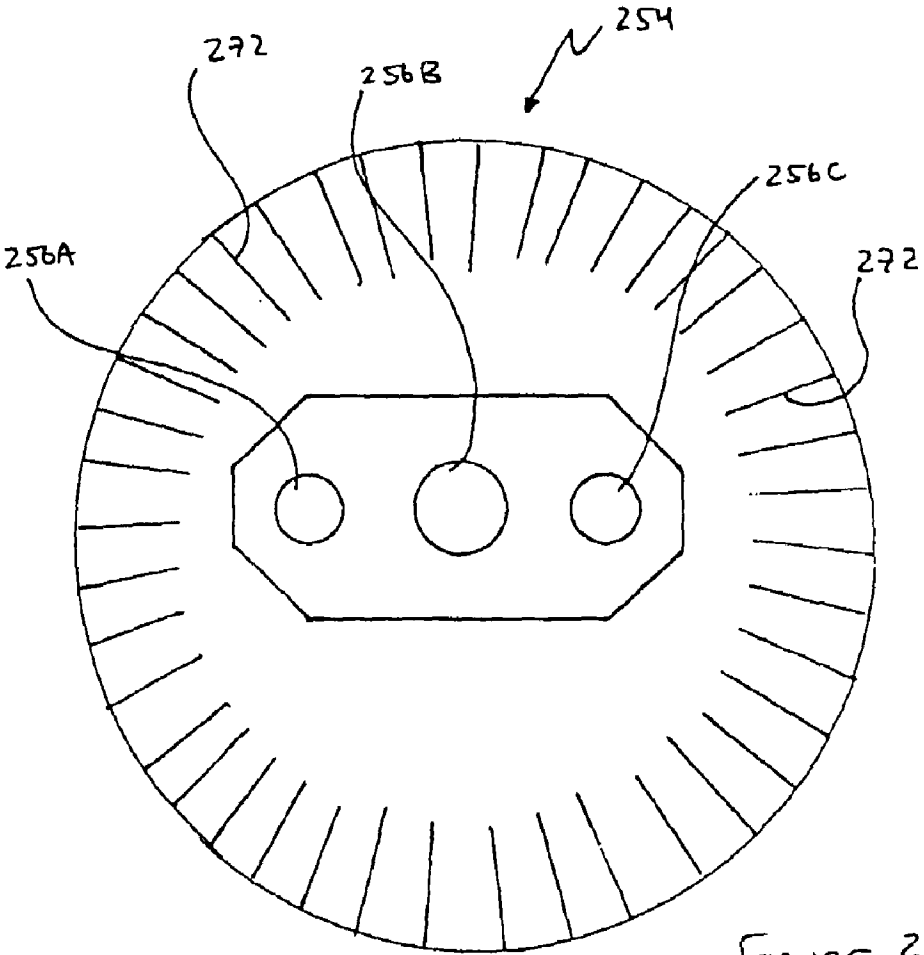
FIG. 21 is a bottom view of a binding retaining member suitable for use with the slider retaining member of FIG. 20.
Figure 20:
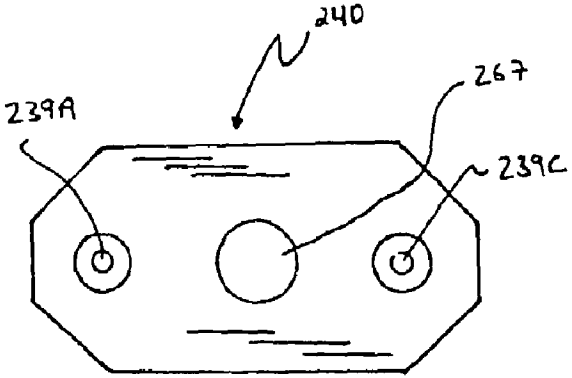
FIG. 20 is a top view of a slider retaining member suitable for use with a binding mounting system similar to that of FIG. 14.

FIGS. 20-21 depict an alternatively shaped embodiment of slider retaining member 240 and binding retaining member 254 which are suitable for use in binding mounting systems similar to those of FIGS. 14-19. In the embodiment of FIGS. 20-21, slider retaining member 240 is polygonal in shape and does not have holes 269 or lobes 276. In other respects, slider retaining member 240 of FIG. 20 is substantially similar to slider retaining member 240 of FIG. 18. In the embodiment of FIGS. 20-21, binding retaining member 254 has a recessed region 271 which is polygonal in shape and lacks holes 277. In other respects, binding retaining member 254 of FIG. 20 is substantially similar to binding retaining member 254 of FIG. 19.

Figures 22, 23:
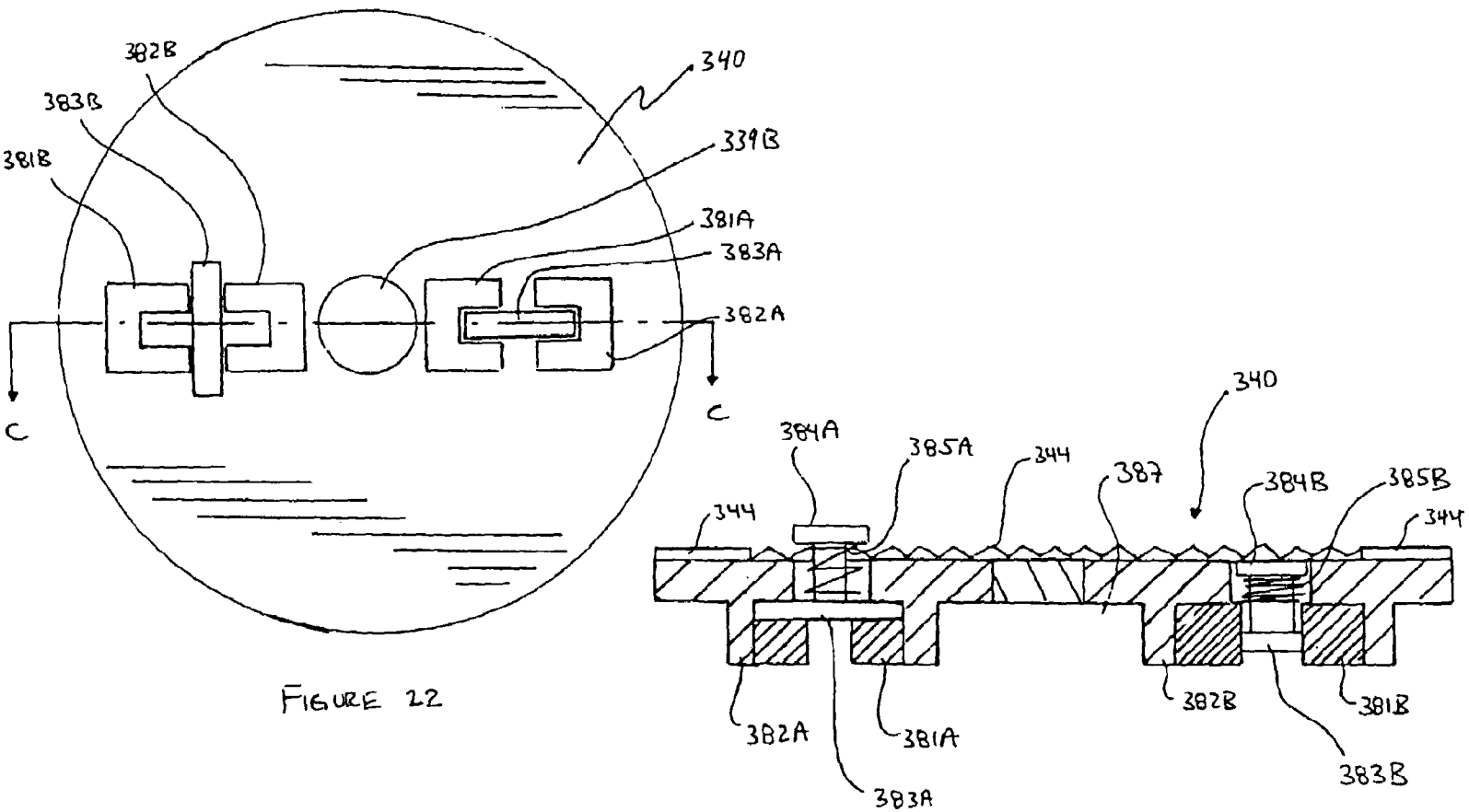
FIG. 22 is a bottom view of a slider retaining member with alternative fastener components.
FIG. 23 is a partial cross-sectional view of the slider retaining member of FIG. 22.
Figure 24:
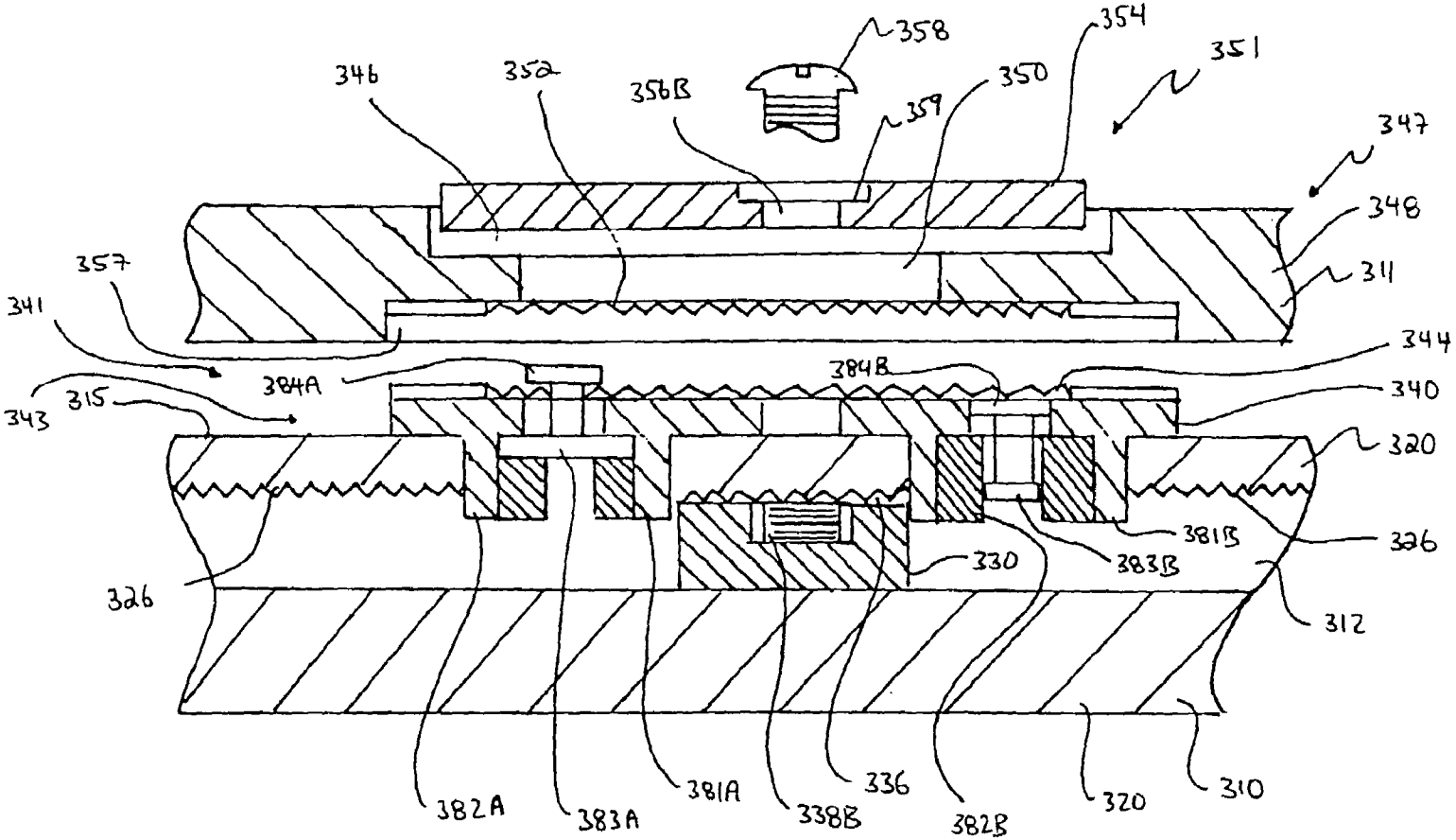
FIG. 24 is a partial cross-section along the line A-A (FIG. 1) of a binding mounting system incorporating the slider retaining member of FIG. 22.

FIGS. 22-24 show different views of a slider retaining member 340 and a binding mounting system according to an alternative embodiment of the invention. In many respects, the binding mounting system of FIGS. 22-24 is similar to the binding mounting system of FIGS. 1-9. Features of the binding mounting system of FIGS. 22-24 are accorded reference numbers that are the same as those of similar features of the binding mounting system of FIGS. 1-9, except that the reference numbers of the binding mounting system of FIGS. 22-24 are preceded by a "3".

The binding mounting system of FIGS. 22-24 differs from the binding mounting system of FIGS. 1-9 in that slider retaining mechanism 341 comprises alternative fasteners 384A, 384B in the place of fasteners components 38A, 38C and 42A, 42C. In the embodiment of FIGS. 22-24, each of fasteners 384 on slider retaining member 340 comprises a pair of "U-shaped" extensions 381, 382 which extend downwardly from slider retaining member 340 into slot 322. Fastener 384A extends through slider retaining disc 340 to provide a bottom fastener portion 383A located between extensions 381A, 382A and fastener 384B extends through slider retaining member 340 to provide a bottom fastener portion 383B located between extensions 381B, 382B. Slider member 330 extends upwardly between fasteners 384A, 384B into region 387 of slider retaining member 340. Movement of slider member 330 is constrained by extension 381A and by extension 382B.

In the illustrated embodiment of FIGS. 22-24, fastener 384A is shown in an unlocked configuration, where bottom fastener portion 383A extends longitudinally between extensions 381A, 382A and fastener component 384B is shown in a locked configuration, where bottom fastener portion 383B extends transversely between extensions 381B, 382B. A person may push downwardly and rotate fasteners 384A, 384B to switch them between their locked and unlocked configurations. A tool may be used for this purpose. When fasteners 384A, 384B are in their locked positions, the bias of springs 385A, 385B causes bottom fastener portions 383A, 383B to exert upward pressure on shoulders 224 of chamber 212. This upward pressure fixes the longitudinal position of slider retaining member 354 relative to board 310. Because extensions 381, 382 extend downwardly from slider retaining member 340 into slot 322 on either side of slider member 330, slider member 330 is prevented from moving longitudinally relative to board 310.

As discussed in the embodiment of FIGS. 1-9, fastener component 358 may extend through binding retaining member 354, binding base plate 348 and slider-retaining member 340 and may be coupled to fastener component 338B. Fastener components 358 and 338B provide additional strength to longitudinal slider retaining mechanism 341 provided by fasteners 384A, 384B.

Other components and features of the binding mounting system of FIGS. 22-24 are similar to corresponding components and features of the binding mounting system of FIGS. 1-9 and are not discussed further herein.

Figure 25:
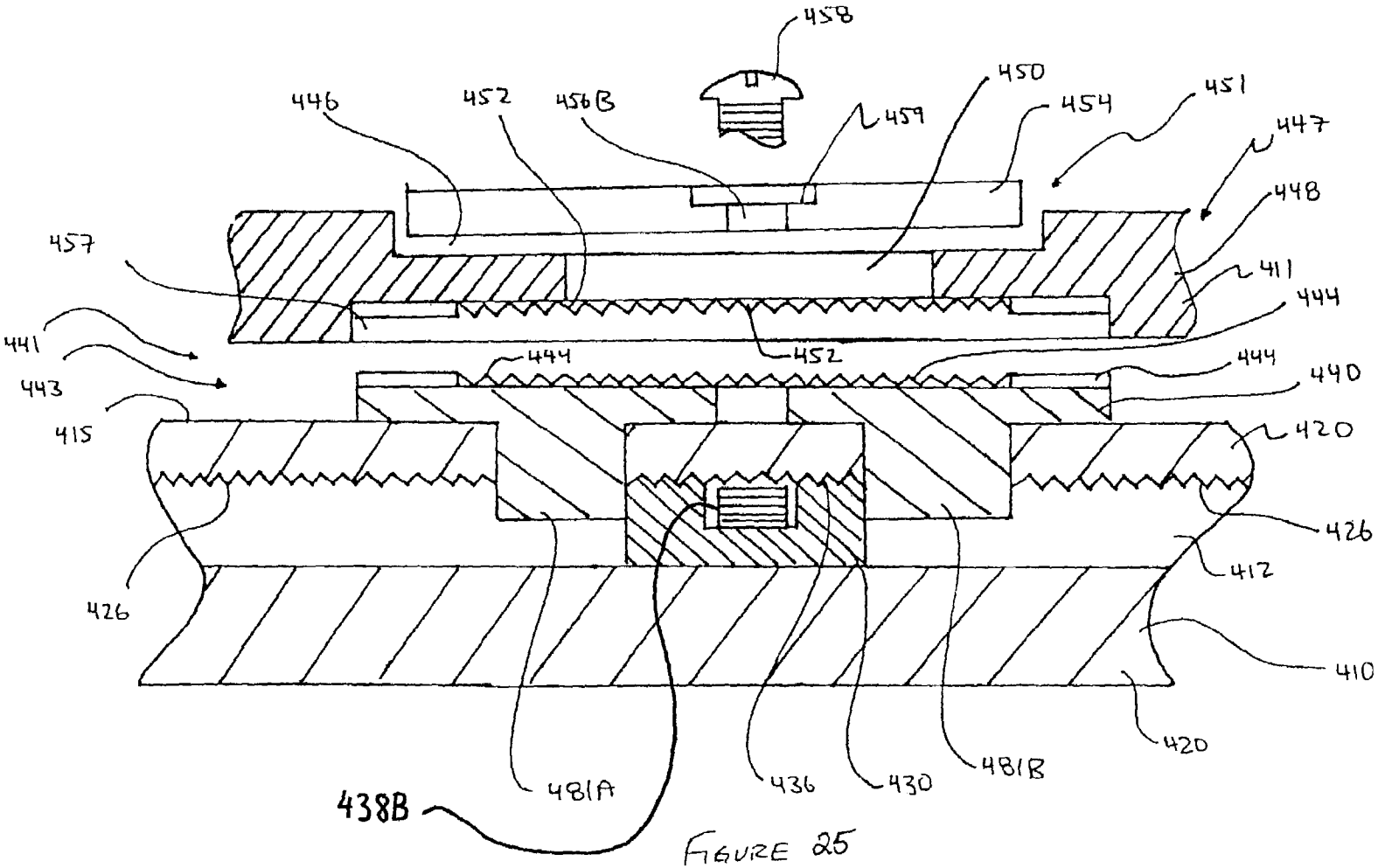
FIG. 25 is a partial cross-section along the line A-A (FIG. 1) of a binding mounting system according to another embodiment of the invention.

FIG. 25 depicts a binding mounting system according to yet another alternative embodiment of the invention. In many respects, the binding mounting system of FIG. 25 is similar to the binding mounting systems of FIGS. 22-24 and FIGS. 1-9. Features of the binding mounting system of FIG. 25 are accorded reference numbers that are the same as those of similar features of the binding mounting systems of FIGS. 22-24 and FIGS. 1-9, except that the reference numbers of the binding mounting system of FIG. 25 are preceded by a "4".

The binding mounting system of FIG. 25 is similar to the binding mounting system of FIGS. 22-24 in that slider retaining member 440 comprises extensions 481A, 481B which extend downwardly from slider retaining member 440 into slot 422 and in that slider member 430 extends upwardly between extensions 481A, 481B. Longitudinal movement of slider member 430 is constrained by extensions 481A, 481B.

As discussed in the embodiment of FIGS. 1-9, fastener component 458 may extend through binding retaining member 454, binding base plate 448 and slider retaining member 440 and may be coupled to fastener component 438B.

Other components and features of the binding mounting system of FIG. 25 are similar to corresponding components and features of the binding mounting systems of FIGS. 22-24 and FIGS. 1-9 and are not discussed further herein.

As will be apparent to those skilled in the art in the light of the foregoing disclosure, many alterations and modifications are possible in the practice of this invention without departing from the spirit or scope thereof. For example:

The binding mounting systems described above are not limited to the particular application where the recreational board is a snowboard and the bindings are snowboard bindings. Those skilled in the art will appreciate that the innovative binding mounting system of the present invention may be used in a variety of other sports or activities where a rider's feet are retained by bindings to a rider support surface of a recreational board. By way of non-limiting example, the binding mounting system of the present invention may be used to mount bindings to surfboards, windsurf boards, wakeboards, sky surfing boards, kitesurfing boards or the like.

In the above described embodiments, the slider members and the undersurfaces of the shoulders of the chambers are described as having transversely extending ridges. In alternative embodiments, the slider members and the undersurfaces of the shoulders have different profiles of comprise different materials which engage one another. For example, one of the slider member and the undersurface of the shoulders may comprise a series of projections and the other may comprise a series of indentations. Such projections and indentations may have a wide variety of shapes. In an alternative example, the slider member and/or the undersurface of the shoulders may be faced with elastomeric material that creates a gripping force when deformed.

In some of the above-described embodiments, the slider retaining member is shown as being disc-shaped (i.e. with a circular perimeter). This is not the case in all embodiments. In general, the slider retaining member may have any shape, provided that the binding base plate can pivot with respect to the slider retaining member to allow adjustment of the angular orientation of the binding base plate and the binding as described above.

In some of the above described embodiments, the slider retaining member is described as having upwardly facing, radially extending ridges and the binding base plate is described as having downwardly facing, radially extending ridges. It is not strictly necessary that these ridges be radially extending. Preferably, however, the slider retaining member comprises upwardly facing ridges, which correspond with and which are capable of engaging with the downwardly facing ridges on the binding base plate to prevent pivotal movement of the binding base plate and the binding with respect to the board.

In some of the above described embodiments, the binding retaining member is shown as being disc-shaped (i.e. with a circular perimeter). This is not the case in all embodiments. In general, the binding retaining member may have any shape, provided that the binding base plate can pivot with respect to the binding retaining member to allow adjustment of the angular orientation of the binding base plate and the binding as described above.

In the above described embodiments depicted in FIGS. 14-19, binding base plate 248 is described as having upwardly facing, radially extending ridges 274 and binding retaining member 254 is described as having downwardly facing, radially extending ridges 272. It is not strictly necessary that these ridges be radially extending. Preferably, however, binding retaining member 254 comprises downwardly facing ridges, which correspond with and which are capable of engaging with the upwardly facing ridges on binding base plate 248 to prevent pivotal movement of binding base plate 248 and binding 211 with respect to board 210.

In the embodiments described above, the chamber is located beneath the upper surface of the board. In such embodiments, the upper surface of the board is the rider support surface and the chamber is formed between the layers of the board. In alternative embodiments, the chamber is located above the upper surface of the board. Chambers located above the upper surface of the board may be formed integrally with the board or may comprise separate chamber containing components which are coupled to the upper surface of the board. In embodiments where the chamber is located above the upper surface of the board, the rider support surface may also be spaced upwardly from the upper surface of the board.

Accordingly, the scope of the invention is to be construed in accordance with the substance defined by the following claims.

What is claimed is:

1. A system for mounting a binding to a recreational board, the system comprising:

a recreational board comprising a longitudinally extending chamber;

a slider assembly comprising a slider member positionable such that at least a portion of the slider member is located within the chamber and a slider retaining mechanism for engaging the slider member, the slider assembly adjustable to a slider adjustment configuration wherein the slider member is longitudinally moveable relative to the chamber and to a slider lock configuration wherein the slider member is fixed relative to the chamber; and a binding assembly comprising a binding, at least a portion of which is positionable atop a rider support surface of the board, and a binding retaining mechanism for coupling the binding to the slider assembly, the binding assembly adjustable to an angular adjustment configuration wherein an angular orientation of the binding is adjustable relative to the board and to an angular lock configuration wherein the angular orientation of the binding is fixed relative to the board;

wherein the binding assembly is adjustable between its angular adjustment and angular lock configurations while the slider assembly is in its slider lock configuration.

2. A system according to claim 1 wherein the slider assembly is adjustable between its slider adjustment and slider lock configurations while the binding assembly is in its angular lock configuration.

3. A system according to claim 1 wherein the chamber comprises one or more shoulders having downwardly facing, transversely extending ridges located thereon.

4. A system according to claim 3 wherein the slider member comprises upwardly facing, transversely extending ridges for engaging the downwardly facing, transversely extending ridges when the slider assembly is in its slider lock configuration.

5. A system for mounting a binding to a recreational board, the system comprising:

a recreational board comprising a longitudinally extending chamber;

a slider assembly comprising a slider member positionable such that at least a portion of the slider member is located within the chamber and a slider retaining mechanism for engaging the slider member, the slider assembly adjustable to a slider adjustment configuration wherein the slider member is longitudinally moveable relative to the chamber and to a slider lock configuration wherein the slider member is fixed relative to the chamber; and a binding assembly comprising a binding, at least a portion of which is positionable atop a rider support surface of the board, and a binding retaining mechanism for coupling the binding to the slider assembly, the binding assembly adjustable to an angular adjustment configuration wherein an angular orientation of the binding is adjustable relative to the board and to an angular lock configuration wherein the angular orientation of the binding is fixed relative to the board;

wherein the slider assembly is adjustable between its slider adjustment and slider lock configurations while the binding assembly is in its angular lock configuration.

6. A system for mounting a binding to a recreational board, the system comprising:

a recreational board comprising a longitudinally extending chamber;

a slider assembly comprising a slider member positionable such that at least a portion of the slider member is located within the chamber and a slider retaining mechanism for engaging the slider member, the slider assembly adjustable to a slider adjustment configuration wherein the slider member is longitudinally moveable relative to the chamber and to a slider lock configuration wherein the slider member is fixed relative to the chamber; and a binding assembly comprising a binding, at least a portion of which is positionable atop a rider support surface of the board, and a binding retaining mechanism for coupling the binding to the slider assembly. the binding retaining mechanism itself adjustable to an angular adjustment configuration wherein an angular orientation of the binding is adjustable relative to the board and to an angular lock configuration wherein the angular orientation of the binding is fixed relative to the board;

wherein the slider retaining mechanism comprises a slider retaining member which is positionable on the rider support surface of the board and one or more fastener components which cooperate with one or more corresponding fastener components on the slider member to couple the slider retaining member to the slider member.

7. A system according to claim 6 wherein the binding comprises a recessed region and at least a portion of the slider retaining member extends upwardly from the rider support surface of the board into the recessed region.

8. A system according to claim 6 wherein the binding comprises a binding base plate, at least a portion of which is positionable atop a rider support surface and wherein the binding retaining mechanism comprises one or more fastener components for coupling the binding base plate to one or more corresponding fastener components on the slider retaining member.

9. A system for mounting a binding to a recreational board, the system comprising:

a recreational board comprising a longitudinally extending chamber;

a slider assembly comprising a slider member positionable such that at least a portion of the slider member is located within the chamber and a slider retaining mechanism for engaging the slider member, the slider assembly adjustable to a slider adjustment configuration wherein the slider member is longitudinally moveable relative to the chamber and to a slider lock configuration wherein the slider member is fixed relative to the chamber; and a binding assembly comprising a binding, at least a portion of which is positionable atop a rider support surface of the board, and a binding retaining mechanism for coupling the binding to the slider assembly, the binding assembly adjustable to an angular adjustment configuration wherein an angular orientation of the binding is adjustable relative to the board and to an angular lock configuration wherein the angular orientation of the binding is fixed relative to the board;

wherein the slider retaining mechanism comprises a slider retaining member which is positionable on the rider support surface of the board and one or more fastener components which cooperate with one or more corresponding fastener components on the slider member to couple the slider retaining member to the slider member; and wherein the binding retaining mechanism comprises a binding retaining member which is positionable atop a portion of the binding and one or more fastener components which cooperate with one or more corresponding fastener components on the slider assembly to couple the binding retaining member to the slider assembly.

10. A system according to claim 9 wherein the binding retaining member comprises one or more apertures, for providing access to the fastener components which couple the slider retaining member to the slider member.

11. A system according to claim 9 wherein the binding retaining member has a substantially circular perimeter.

12. A system according to claim 9 wherein the binding retaining member comprises a recessed region and at least a portion of the slider retaining member extends upwardly from the rider support surface of the board into the recessed region.

13. A system according to claim 9 wherein the binding retaining member comprises downwardly facing ridges and the binding comprises corresponding upwardly facing ridges for engaging the downwardly facing ridges of the binding retaining member when the binding assembly is in its angular lock configuration.

14. A system according to claim 13 wherein the ridges on the binding retaining member and the binding comprise annular zones of radially extending ridges.

15. A system according to claim 9 wherein the slider retaining member comprises upwardly facing ridges and the binding comprises corresponding downwardly facing ridges for engaging the upwardly facing ridges of the slider retaining member when the binding assembly is in its angular lock configuration.

16. A system according to claim 15 wherein the ridges on the slider retaining member and the binding comprise annular zones of radially extending ridges.

17. A system according to claim 9 wherein the one or more corresponding fastener components of the slider assembly are located on the slider retaining member.

18. A system according to claim 9 wherein the one or more corresponding fastener components of the slider assembly are located on the slider member.

19. A system for mounting a binding to a recreational board, the system comprising:

a recreational board comprising a longitudinally extending chamber;

a slider assembly comprising a slider member positionable such that at least a portion of the slider member is located within the chamber and a slider retaining member at least a portion of which is positionable atop a rider support surface of the board and adjacent to the chamber, the slider retaining member selectively engageable with the slider member; and a binding assembly comprising a binding base plate, at least a portion of which is positionable atop the rider support surface, and a binding retaining member, at least a portion of which is positionable atop the binding base plate, the binding retaining member coupleable to at least one of: the slider retaining member and the slider member.

20. A binding mounting system according to claim 19 wherein the slider assembly comprises a slider retaining mechanism for coupling the slider retaining member to the slider member, the slider retaining mechanism adjustable to a slider adjustment configuration where the slider member is longitudinally moveable relative to the chamber and a slider lock configuration where a longitudinal position of the slider member is fixed relative to the chamber.

21. A binding mounting system according to claim 20 wherein the binding assembly comprises a binding retaining mechanism for coupling the binding retaining member to at least one of: the slider retaining member and the slider member, the binding retaining mechanism adjustable to an angular adjustment configuration where an angular orientation of the binding base plate is adjustable relative to the board and an angular lock configuration where the angular orientation of the binding base plate is fixed relative to the board.

22. A binding mounting system according to claim 19 wherein the chamber comprises one or more shoulders and a slot which extends from the chamber and opens upwardly onto the rider support surface.

23. A binding mounting system according to claim 22 comprising a plurality of downwardly facing, transversely extending ridges located on an undersurface of the shoulders.

24. A binding mounting system according to claim 23 wherein the downwardly facing, transversely extending ridges are formed on an chamber insert member which is fabricated separately from the board and which is inserted into the chamber to bear against the shoulders.

25. A binding mounting system according to claim 23 wherein the downwardly facing, transversely extending ridges comprise one or more layers used to fabricate the board and wherein the downwardly facing, transversely extending ridges are formed during fabrication of the board.

26. A binding mounting system according to claim 23 wherein the portion of the slider member located within the chamber comprises a plurality of upwardly facing, transversely extending ridges for engaging the downwardly facing, transversely extending ridges.

27. A binding mounting system according to claim 26 wherein the slider assembly comprises a slider retaining mechanism for coupling the slider retaining member to the slider member, the slider retaining mechanism adjustable to a slider adjustment configuration where the upwardly facing, transversely extending ridges of the slider member are disengaged from the downwardly facing, transversely extending ridges of the chamber and the slider member is longitudinally moveable relative to the chamber and a slider lock configuration where the upwardly facing, transversely extending ridges of the slider member engage the downwardly facing, transversely extending ridges of the chamber and a longitudinal position of the slider member is fixed relative to the chamber.

28. A binding mounting system according to claim 19 wherein an upward facing surface of the slider retaining member comprises a plurality of upwardly facing ridges and a downwardly facing surface of the binding base plate comprises a corresponding plurality of downwardly facing ridges for engaging the upwardly facing ridges of the slider retaining member.

29. A binding mounting system according to claim 28 wherein the binding assembly comprises a binding retaining mechanism for coupling the binding retaining member to at least one of: the slider retaining member and the slider member, the binding retaining mechanism adjustable to an angular adjustment configuration where the upwardly facing ridges of the slider retaining member are disengaged from the downwardly facing ridges of the binding base plate and an angular orientation of the binding base plate is adjustable relative to the board and an angular lock configuration where the upwardly facing ridges of the slider retaining member engage the downwardly facing ridges of the binding base plate and the angular orientation of the binding base plate is fixed relative to the board.

30. A binding mounting system according to claim 29 wherein the upwardly facing ridges of the slider retaining member and the downwardly facing ridges of the binding base plate comprise annular zones of radially extending ridges.

31. A binding mounting system according to claim 29 wherein the binding retaining mechanism comprises one or more fastener components located on the slider member.

32. A binding mounting system according to claim 31 wherein the binding retaining mechanism comprises one or more fastener components which extend through one or more corresponding holes in the binding retaining member to engage the one or more fastener components located on the slider member.

33. A binding mounting system according to claim 29 wherein the binding retaining mechanism comprises one or more fastener components located on the slider retaining member.

34. A binding mounting system according to claim 19 wherein a downwardly facing surface of the binding retaining member comprises a plurality of downwardly facing ridges and an upwardly facing surface of the binding base plate comprises a corresponding plurality of upwardly facing ridges for engaging the downwardly facing ridges of the binding retaining member.

35. A binding mounting system according to claim 34 wherein the binding assembly comprises a binding retaining mechanism for coupling the binding retaining member to at least one of: the slider retaining member and the slider member, the binding retaining mechanism adjustable to an angular adjustment configuration where the downwardly facing ridges of the binding retaining member are disengaged from the upwardly facing ridges of the binding base plate and an angular orientation of the binding base plate is adjustable relative to the board and an angular lock configuration where the downwardly facing ridges of the binding retaining member engage the upwardly facing ridges of the binding base plate and the angular orientation of the binding base plate is fixed relative to the board.

36. A system for mounting a binding to a recreational board, the system comprising:

a recreational board comprising a longitudinally extending chamber;

a slider assembly comprising a slider member positionable such that at least a portion of the slider member is located within the chamber and a slider retaining member positionable adjacent to the chamber and selectively engageable with the slider member; and a binding assembly comprising a binding base plate, at least a portion of which is positionable atop a rider support surface, and a binding retaining member, at least a portion of which is positionable atop the binding base plate, the binding retaining member coupleable to at least one of: the slider retaining member and the slider member;

wherein the chamber comprises one or more shoulders and a slot which extends from the chamber and opens upwardly onto the rider support surface and a plurality of downwardly facing, transversely extending ridges located on an undersurface of the shoulders;

wherein the portion of the slider member located within the chamber comprises a plurality of upwardly facing, transversely extending ridges for engaging the downwardly facing, transversely extending ridges;

wherein the slider assembly comprises a slider retaining mechanism for coupling the slider retaining member to the slider member, the slider retaining mechanism adjustable to a slider adjustment configuration where the upwardly facing, transversely extending ridges of the slider member are disengaged from the downwardly facing, transversely extending ridges of the chamber and the slider member is longitudinally moveable relative to the chamber and a slider lock configuration where the upwardly facing, transversely extending ridges of the slider member engage the downwardly facing, transversely extending ridges of the chamber and a longitudinal position of the slider member is fixed relative to the chamber; and wherein the slider retaining mechanism comprises one or more fastener components located on the slider member and one or more fastener components which extend through one or more corresponding holes in the slider retaining member to engage the one or more fastener components located on the slider member.

37. A binding mounting system according to claim 36 wherein, when the binding base plate is positioned atop the slider retaining member, each of the one or more fastener components which extend through the one or more corresponding holes in the slider retaining member is accessible through one or more apertures that extend through the binding base plate.

38. A binding mounting system according to claim 27 wherein the binding retaining member comprises one or more holes that extend through the binding retaining member and when the binding retaining member is positioned atop the binding base plate, each of the one or more fastener components which extend through the one or more corresponding holes in the slider retaining member is accessible through the one or more apertures that extend through the binding base plate and through the one or more holes that extend through the binding retaining member.

39. A system for mounting a binding to a recreational board, the system comprising:

a recreational board comprising a longitudinally extending chamber;

a slider assembly comprising a slider member positionable such that at least a portion of the slider member is located within the chamber and a slider retaining member positionable adjacent to the chamber and selectively engageable with the slider member wherein an upward facing surface of the slider retaining member comprises a plurality of upwardly facing ridges and a downwardly facing surface of the binding base plate comprises a corresponding plurality of downwardly facing ridges for engaging the upwardly facing ridges of the slider retaining member; and a binding assembly comprising a binding base plate, at least a portion of which is positionable atop a rider support surface, and a binding retaining member, at least a portion of which is positionable atop the binding base plate, the binding retaining member coupleable to at least one of: the slider retaining member and the slider member, wherein the binding assembly comprises a binding retaining mechanism for coupling the binding retaining member to at least one of: the slider retaining member and the slider member, the binding retaining mechanism adjustable to an angular adjustment configuration where the upwardly facing ridges of the slider retaining member are disengaged from the downwardly facing ridges of the binding base plate and an angular orientation of the binding base plate is adjustable relative to the board and an angular lock configuration where the upwardly facing ridges of the slider retaining member engage the downwardly facing ridges of the binding base plate and the angular orientation of the binding base plate is fixed relative to the board;

wherein the binding retaining mechanism comprises one or more fastener components located on the slider retaining member; and wherein the binding retaining mechanism comprises one or more fastener components which extend through one or more corresponding holes in the binding retaining member to engage the one or more fastener components located on the slider retaining member.

40. A system for mounting a binding to a recreational board, the system comprising:

a recreational board comprising a longitudinally extending chamber;

a slider member positionable such that at least a portion of the slider member is located within the chamber;

a slider retaining member positionable adjacent to the chamber and selectively engageable with the slider member;

a binding comprising a binding base plate, at least a portion of the binding base plate positionable atop a rider support surface of the board; and a binding retaining member, at least a portion of which is positionable atop the binding base plate, the binding retaining member coupleable to at least one of: the slider member and the slider retaining member.

41. A system for mounting a binding to a recreational board, the system comprising:

a recreational board comprising a longitudinally extending chamber;

a slider member positionable such that at least a portion of the slider member is located within the chamber;

a slider retaining member positionable adjacent to the chamber and selectively engageable with the slider member;

a binding comprising a binding base plate, at least a portion of the binding base plate positionable atop a rider support surface of the board; and a binding retaining member, at least a portion of which is positionable atop the binding base plate, the binding retaining member coupleable to at least one of: the slider member and the slider retaining member;

wherein the one or more fastener components of the binding retaining mechanism project through one or more corresponding holes in the binding base plate.

42. A system according to claim 41 wherein the binding base plate comprises one or more apertures for providing access, through the binding base plate, to the fastener components which coupled the slider retaining member to the slider member.

* * * * *